US010847893B2

(12) United States Patent
Dominocielo et al.

(10) Patent No.: US 10,847,893 B2
(45) Date of Patent: Nov. 24, 2020

(54) ARTICULATED FOLDING RIB REFLECTOR FOR CONCENTRATING RADIATION

(71) Applicant: UMBRA LAB, INC., Santa Barbara, CA (US)

(72) Inventors: Gabe Dominocielo, Santa Barbara, CA (US); David Langan, Santa Barbara, CA (US)

(73) Assignee: Umbra Lab, Inc., Santa Barbara, CA (US)

( * ) Notice: Subject to any disclaimer, the term of this patent is extended or adjusted under 35 U.S.C. 154(b) by 23 days.

(21) Appl. No.: 16/240,485

(22) Filed: Jan. 4, 2019

(65) Prior Publication Data

US 2019/0214737 A1 Jul. 11, 2019

Related U.S. Application Data

(60) Provisional application No. 62/614,842, filed on Jan. 8, 2018.

(51) Int. Cl.
*H01Q 15/16* (2006.01)
*H01Q 1/36* (2006.01)
*H01Q 1/12* (2006.01)

(52) U.S. Cl.
CPC ..... *H01Q 15/161* (2013.01); *H01Q 1/1235* (2013.01); *H01Q 1/36* (2013.01)

(58) Field of Classification Search
CPC .... H01Q 15/16; H01Q 15/161; H01Q 15/168; H01Q 1/12; H01Q 1/1235; H01Q 1/36
See application file for complete search history.

(56) References Cited

U.S. PATENT DOCUMENTS 3,406,404 A 10/1968 Maier
3,496,687 A * 2/1970 Greenberg ..... H01Q 15/161 52/109

(Continued)

FOREIGN PATENT DOCUMENTS

CN 106207483 A 12/2016
JP H 60-178706 A 9/1985

(Continued)

OTHER PUBLICATIONS https://directory.eoportal.org/web/eoportal/satellite-missions/r/raincube, Accessed Dec. 6, 2018, 12 pages.

(Continued)

*Primary Examiner* — Jason Crawford
(74) *Attorney, Agent, or Firm* — Lewis Roca Rothgerber Christie LLP

(57) ABSTRACT

A reflector assembly configured to move between a stowed configuration and a deployed configuration includes a central hub, a series of ribs coupled to the central hub, and a flexible reflective material attached to the ribs. Each rib includes a root rib, an intermediate rib, and a tip rib. The root rib is configured to rotate in a first direction about a first axis away from a coaxial axis of the central hub, the intermediate rib is configured to rotate in the first direction about a second axis substantially parallel to the first axis, and the tip rib is configured to rotate in the first direction about a third axis substantially parallel to the second axis as the reflector assembly moves into the deployed configuration. The flexible reflective material and the ribs together form a reflective surface with a substantially paraboloidal surface profile configured to focus electromagnetic energy.

23 Claims, 21 Drawing Sheets

(56) References Cited

U.S. PATENT DOCUMENTS 3,631,505 A * 12/1971 Carman ..... H01Q 15/161 343/915
3,717,879 A * 2/1973 Ganssle ..... H01Q 15/162 343/915
4,642,652 A * 2/1987 Herbig ..... H01Q 15/161 343/915
4,658,265 A * 4/1987 Heinze ..... H01Q 1/08 343/881
4,780,726 A * 10/1988 Archer ..... H01Q 15/161 343/881
5,104,211 A * 4/1992 Schumacher ..... F24S 23/81 359/853
5,515,067 A 5/1996 Rits
5,680,145 A * 10/1997 Thomson ..... F24S 23/715 343/915
5,864,320 A * 1/1999 Baghdasarian ..... B64G 1/22 16/335
5,864,324 A * 1/1999 Acker ..... H01Q 15/161 343/912
6,028,570 A * 2/2000 Gilger ..... H01Q 1/288 343/880
8,508,430 B2 * 8/2013 Palmer ..... H01Q 15/161 343/915
2003/0140589 A1 7/2003 Yamawaki et al.
2012/0193498 A1 * 8/2012 Tabata ..... H01Q 15/161 248/346.3
2013/0141307 A1 * 6/2013 Numberger ..... H01Q 15/16 343/912
2015/0303582 A1 * 10/2015 Meschini ..... H01Q 15/161 343/840
2016/0352022 A1 * 12/2016 Thomson ..... H01Q 1/288

FOREIGN PATENT DOCUMENTS

JP H 61-157103 A 7/1986
JP H 02-237202 A 9/1990
JP H 04-160802 A 6/1992
JP H 04-160803 A 6/1992
JP H 07-183723 A 7/1995

OTHER PUBLICATIONS

International Search Report and Written Opinion for Application No. PCT/US2019/012396, dated Jun. 12, 2020, 17 pages.

* cited by examiner

ARTICULATED FOLDING RIB REFLECTOR FOR CONCENTRATING RADIATION

CROSS-REFERENCE TO RELATED APPLICATION

The present application claims priority to and the benefit of U.S. Provisional Patent Application No. 62/614,842, filed on Jan. 8, 2018 in the U.S. Patent and Trademark Office, the entire content of which is incorporated herein by reference.

FIELD

The present disclosure relates generally to electromagnetic radiation reflectors configured to function as large apertures for antennas.

BACKGROUND

Reflectors for focusing electromagnetic radiation are installed on a variety of platforms including spacecraft, aircraft, ground mobile vehicles, and fixed ground installations. They are often employed as a component in radio frequency and microwave antenna systems supporting varied applications including, for example, radio astronomy, communications and radar. As is known to a person of ordinary skill in the art, antennas which employ reflectors with large aperture areas are desirable because increasing aperture area improves antenna directivity and gain. Further, antennas incorporating reflectors are the commonly used in many applications, especially applications involving spacecraft, due to their lightweight, efficiency and broadband performance.

A parabolic reflector is a commonly used reflector in which the reflective surface closely approximates a section of a paraboloid. The surface is generated by revolving a parabola, or the section of a parabola, about an axis. An ideal parabolic reflector will focus an incoming plane wave, traveling along the axis of revolution, to a single point, which is referred to as the focal point. In addition to surfaces which substantially approximate a section of a circular paraboloid surface, other surfaces are known to be useful for focusing energy, for example, sections of circular spheroid surfaces and sections of circular hyperboloid surfaces.

Optimum focusing of incident collimated radiation to a point or small diameter circular spot is achieved when the curved surface has a paraboloidal shape. However, the shape of the curved surface may deviate from the paraboloid due to inaccuracies in the manufacturing process, design decisions based on economic consideration, or for other reasons. The shape of the curved surface may also deviate from a paraboloid if the radiation is to be concentrated on an area having an outline other than that of a small diameter circular spot (e.g., if microwave radiation is to be concentrated on an area approximating the outline of a continent).

Reflector surfaces are approximations of ideal surfaces and deviate somewhat relative to these ideal surfaces due to limitations in the design and manufacturing of the reflector. To minimize the radiation pattern error, the deviation from the ideal surface must be limited. The allowable level of deviation may be related to the wavelength of the electromagnetic energy and the desired accuracy of the radiation pattern. The root mean square (RMS) error of the true surface relative to the ideal surface along a unit vector normal to the ideal surface is often limited to 1/10 of the wavelength. At higher frequencies the wavelength is decreased, and therefore the allowable RMS error also decreases.

Satellite technologies are often required to be sufficiently robust to withstand the rigors of the space environment, to have low mass, and to be reliable. They must also be devised to reside within the limited volume available to contain the spacecraft and its components when transitioning from the Earth to space, and to survive the environmental rigors of this ascent to space. Often this volume is not sufficient to contain the technology when configured in the operational state required of it once in space. Furthermore, the dynamic loads applied during the ascent often exceed the strength of the technology in the operational state. In these cases, it is necessary for the technology to be configured in one state during the ascent to space, in which it conforms to the available volume and has sufficient strength to resist the forces applied during the ascent, and then to transition to another state in which the technology can perform the intended operational function. The former state in which the technology is configured for the ascent to space is commonly referred to as the stowed state, and the latter state in which the technology fulfills the intended operational function is commonly referred to as the deployed state.

It is believed that future space missions will require reflectors with large deployed areas, in which their overall mass is minimized, and in which the stowed volume is compatible with the volumes available to microsatellites of 100 kg or less and satellites utilizing small launch vehicles or rideshare solutions for access to space. Parabolic reflectors, with deployed diameters between 2 and 20 meters, and areal densities of 1 kg/m$^2$ or less are envisioned. Volume constraints represented by a cuboid with dimensions of 24×24×36, and mass constraints of 100 kg or less are typical of economical solutions for placing a satellite or spacecraft in orbit.

When manufacturing a large aperture reflector antenna for space, consideration must be made for sources of error, including, for example, the coefficient of thermal expansion for the selected materials, on-orbit temperatures and temperature gradients, material changes due to the vacuum and radiation environment, and deflections which alter measured data while testing on the ground due to orientation and gravity. Often ground support equipment is required to support large structures intended for space, during fabrication and testing on the ground. In the case of reflector antennas, this ground support equipment may need to be devised to support testing of the electromagnetic radiation pattern produced by the reflector surface or to support measurement of the reflector surface profile in a manner that provides meaningful insight into the reflector performance when it is in the space environment.

A variety of reflector antenna designs exist for focusing electromagnetic energy. However, many conventional antennas are not configured to provide both a large aperture and small stowed antenna volume. Additionally, some conventional antennas utilize complex mechanisms to deploy the reflector and support the reflector in the deployed configuration, such as standoffs and a series of drop cords supported by tension beams. The manufacturing and testing of these complex conventional antennas is often hampered by the difficulties associated with adjusting the length of the drop cords to control the accuracy of the surface profile of the flexible reflective material which constitutes the reflective surface.

Additionally, conventional reflector antennas include a variety of different methods to prevent the flexible reflective material from becoming entangled or bound to portions of the structure before or during deployment, which might otherwise prevent full deployment of the reflector, damage the structure, and/or tear or otherwise damage the flexible reflective material and thereby degrade the precision of the reflector with regards to the focusing of electromagnetic energy. Some conventional mechanisms for deploying the reflector include rotary electromechanical actuators, linear electromechanical actuators translated to rotary motion through linkages, cams, cables, pulleys, and/or screws, pneumatic actuators, and strain energy devices such as springs.

SUMMARY

The present disclosure is directed to various embodiments of a reflector assembly to move between a stowed configuration and a deployed configuration. In one embodiment, the reflector assembly includes a central hub defining a central axis, a series of ribs coupled to the central hub, and a flexible reflective material attached to the series of ribs. Each rib of the series of ribs includes a root rib rotatably coupled to the central hub by a first hinge, an intermediate rib having a proximal end rotatably coupled to a distal end of the root rib by a second hinge, and a tip rib having a proximal end rotatably coupled to a distal end of the intermediate rib by a third hinge. The root rib is configured to rotate in a first direction about a first axis away from the central axis of the central hub as the reflector assembly moves into the deployed configuration, the intermediate rib is configured to rotate in the first direction about a second axis substantially parallel to the first axis as the reflector assembly moves into the deployed configuration, and the tip rib is configured to rotate in the first direction about a third axis substantially parallel to the second axis as the reflector assembly moves into the deployed configuration. The flexible reflective material and the series of ribs together form a reflective surface with a substantially paraboloidal surface profile configured to focus electromagnetic energy when the reflector assembly is in the deployed position.

When the reflector assembly is in the stowed configuration, a longitudinal axis of the root rib of each of the series of ribs may be substantially parallel with the central axis of the central hub, a longitudinal axis of the intermediate rib of each of the series of ribs may be substantially parallel with the central axis of the central hub and positioned between the central axis of the central hub and the longitudinal axis of the root rib, and a longitudinal axis of the tip rib of each of the series of ribs may be substantially parallel with the central axis of the central hub and positioned between the longitudinal axis of the root rib and the longitudinal axis of the intermediate rib.

The root rib of each of the series of ribs may have a concave profile, the intermediate rib of each of the series of ribs may have a concave profile, and the tip rib may be positioned in a space defined between the concave profile of the root rib and the concave profile of the intermediate rib when the reflector assembly is in the stowed configuration.

The reflector assembly may also include a deployment mechanism configured to move at least one of the root rib, the intermediate rib, and the tip rib of at least one rib of the series of ribs into a deployed configuration.

The deployment mechanism may be a pneumatic actuator, a hydraulic actuator (e.g., a paraffin actuator), an electromagnetic actuator, a strain energy device, or a combination thereof.

The deployment mechanism may include a planar quadrilateral linkage and an actuator operably coupled to the planar quadrilateral linkage.

The planar quadrilateral linkage may include a ground link, an input link coupled to the linear actuator and rotatably coupled to the ground link, an output link coupled to the one of the root rib, the intermediate rib, and the tip rib, and rotatably coupled to the ground link, and a floating link rotatably coupled to the output link and the input link. Activation of the actuator is configured to rotate the input link and rotation of the input link is configured to rotate the output link.

The deployment mechanism may include an elastic object that stores mechanical energy when deformed.

The substantially paraboloidal surface profile may be configured to focus electromagnetic energy within a frequency range from approximately 500 MHz to approximately 40 GHz.

The reflector assembly may also include a flexible net coupled to the flexible reflective material and the series of ribs.

The flexible net may include a substantially inextensible material.

The flexible reflective material may include a woven wire mesh.

The deployable reflector may also include a substantially cylindrical central structure coupled to the central hub.

The deployable reflector, in the stowed configuration, may be configured to be contained within a volume of approximately 24 inches×approximately 24 inches×approximately 38 inches.

The deployable reflector in the deployed configuration may have a deployed diameter of approximately 4.0 meters.

The deployable reflector may also include a band extending around the deployable reflector in the stowed configuration, and a hold down and release mechanism coupled to the band. Activation of the hold down and release mechanism is configured release tension in the band and allow the deployable reflector to move into the deployed configuration.

The present disclosure is also directed to various methods of operating a deployable reflector assembly including a central hub, a series of ribs coupled to the central hub each having a root rib rotatably coupled to the central hub, an intermediate rib rotatably coupled to the root rib, and a tip rib rotatably coupled to the intermediate rib, and a flexible reflective material attached to the series of ribs. In one embodiment, the method includes moving the deployable reflector assembly from a stowed configuration to a deployed configuration. Moving the deployable reflector assembly from the stowed configuration to the deployed configuration includes rotating, in a first direction away from the central axis of the central hub, the root rib of each rib of the series of ribs relative to the central hub, rotating, in the first direction, an intermediate rib of each rib of the series of ribs relative to the root rib after the rotating of the root rib, and rotating, in the first direction, a tip rib of each rib of the series of ribs relative to the intermediate rib after the rotating of the intermediate rib.

The method may also include moving the deployable reflector from the deployed configuration to the stowed configuration. Moving the deployable reflector from the deployed configuration to the stowed configuration may include rotating, in a second direction opposite the first direction, the tip rib of each rib of the series of ribs relative to the intermediate rib, rotating, in the second direction, the intermediate rib of each rib of the series of ribs relative to the root rib, and rotating, in the second direction, the root rib of each rib of the series of ribs relative to the central hub.

In the stowed configuration, a longitudinal axis of the root rib of each of the series of ribs may be substantially parallel with the central axis of the central hub, a longitudinal axis of the intermediate rib of each of the series of ribs may be substantially parallel with the central axis of the central hub and positioned between the central axis of the central hub and the longitudinal axis of the root rib, and a longitudinal axis of the tip rib of each of the series of ribs may be substantially parallel with the central axis of the central hub and positioned between the longitudinal axis of the root rib and the longitudinal axis of the intermediate rib.

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

BRIEF DESCRIPTION OF THE DRAWINGS

These and other features and advantages of embodiments of the present disclosure will become more apparent by reference to the following detailed description when considered in conjunction with the following drawings. In the drawings, like reference numerals are used throughout the figures to reference like features and components. The figures are not necessarily drawn to scale.

DETAILED DESCRIPTION

The present disclosure is directed to various embodiments of a parabolic antenna reflector for focusing electromagnetic radiation. The parabolic antenna reflector is configured to stow in a limited volume and reliably deploy for operation (e.g., operation in space). In one or more embodiments, the antenna reflector may be utilized as part of an antenna or payload system in space missions requiring large apertures. The antenna reflectors of the present disclosure may be employed on space missions requiring antennas with very high gain (e.g., to support, for example, radar or communications), and in which the spacecraft, including the stowed antenna reflector, are compatible with rideshare volumes of 24 inches×24 inches by 38 inches. In one or more embodiments of the present disclosure, the parabolic antenna reflector includes a series of articulating ribs each having three or more rib sections, which reduces the height of the antenna reflector in the stowed configuration compared to a conventional folding rib reflector design.

Figure 1:
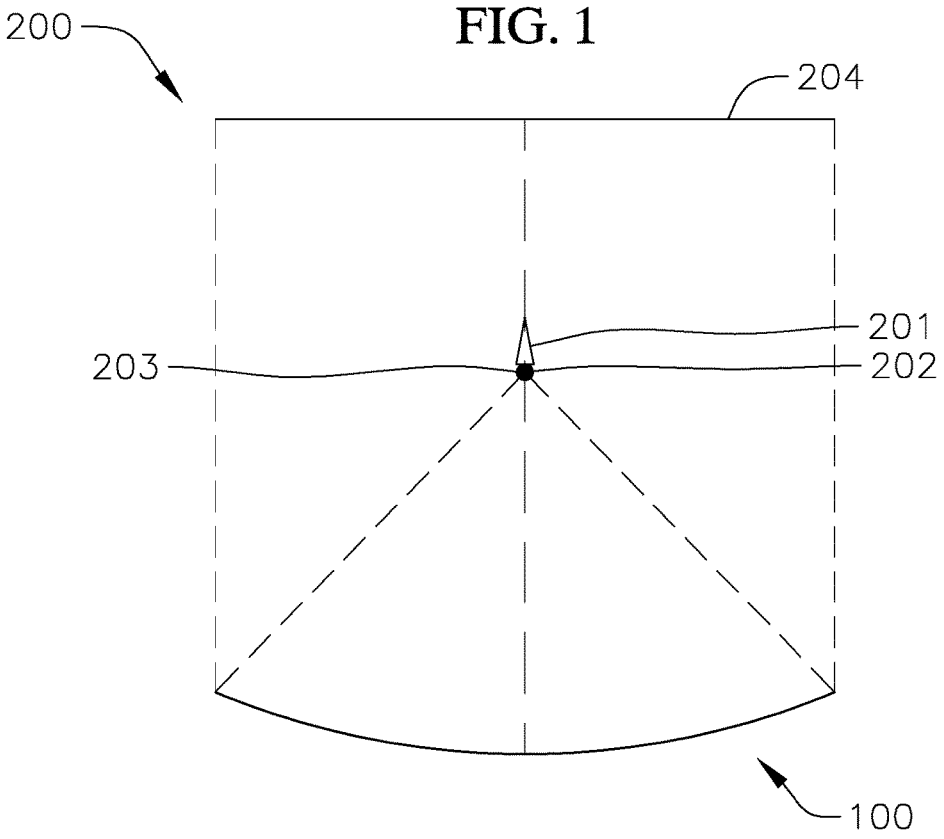
FIG. 1 is a side view of a parabolic reflector according to one embodiment of the present disclosure focusing energy from a plane wave to a focal point located near to an antenna feed.

With reference now to FIG. 1, a parabolic reflector 100 according to one embodiment of the present disclosure may be incorporated into an antenna system 200 including a feed horn 201. In the illustrated embodiment, the feed horn 201 is positioned such that a phase center 202 (i.e., the point from which electromagnetic radiation is emitted) of the feed horn 201 is located at or substantially at a focal point 203 of the reflector 100. The feed horn 201 is configured to radiate electromagnetic energy which, once reflected by the reflector 100, forms a plane wave 204 that is directed away from the antenna system 200. As used herein, the terms "parabolic" and "parabaloidal" surfaces encompass surfaces which deviate from a true paraboloid but which are nevertheless intended to reflect and concentrate incident electromagnetic radiation. Further, when reference is made herein to "parabolic" curves, it will be understood to encompass curves which deviate from true parabolic curves but which are nevertheless intended to approximate curves on a paraboloidal surface and which are intended to reflect and concentrate incident electromagnetic radiation.

Figure 2:
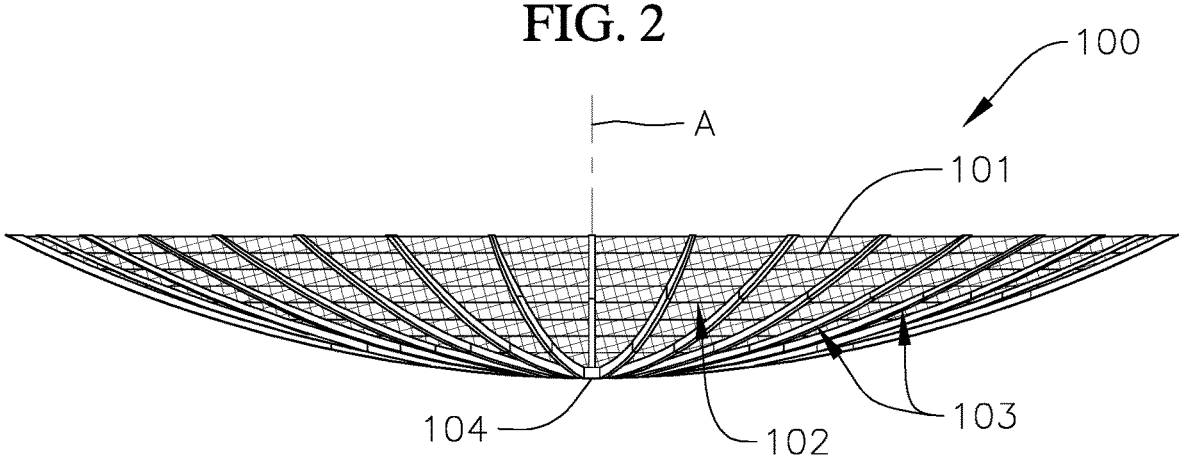
FIG. 2 is a side view of a deployed reflector according to one embodiment of the present disclosure.
Figure 3:
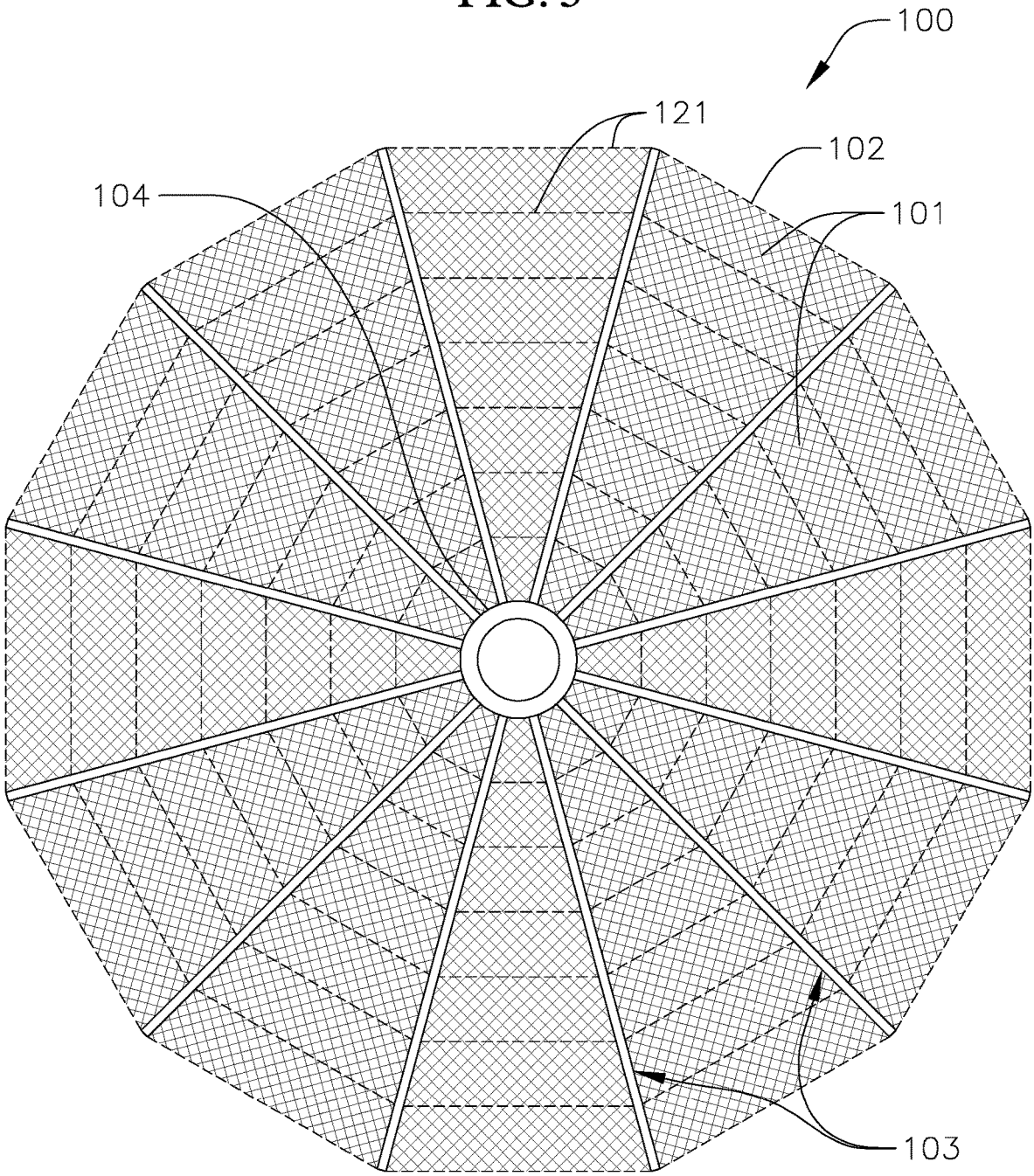
FIG. 3 is a top view of a deployed reflector according to one embodiment of the present disclosure.
Figure 4:
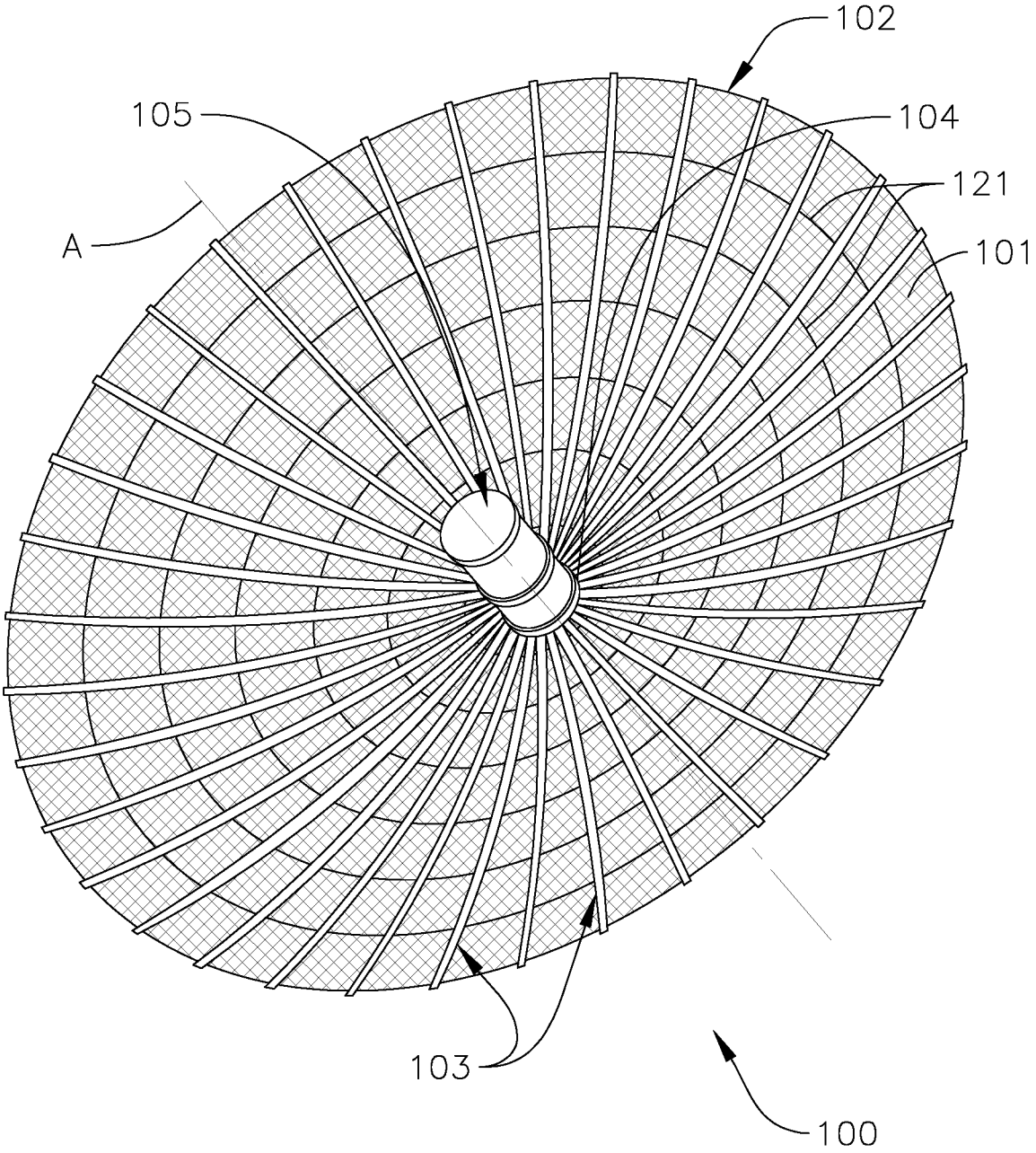
FIG. 4 is a perspective view of a deployed reflector according to one embodiment of the present disclosure with a cylindrical central structure located above the central hub of the reflector.

With reference now to the embodiment illustrated in FIGS. 2-6, the parabolic reflector 100 includes a flexible reflective material 101, a flexible net 102, a plurality of ribs 103, and a central hub 104 defining a central axis A. In the illustrated embodiment, the reflector 100 also includes a central structure 105 coupled to the central hub 104. Additionally, in the illustrated embodiment, the parabolic reflector 100 also includes launch locks 106 (e.g., one launch lock 106 for each rib 103) coupled to the central structure 105 (see FIG. 14), a flexible restraining band 107 extending around an outer periphery of the ribs 103 in a stowed or collapsed configuration (see FIGS. 5 and 14), and a hold down and release mechanism 108 (HDRM) coupled to the flexible restraining band 107. The flexible restraining band 107 is configured to maintain the parabolic reflector 100 in the stowed configuration (e.g., during launch) and actuation of the HDRM 108 is configured to release the flexible restraining band 107 and thereby enable the parabolic reflector 100 to move into a deployed configuration, as illustrated in FIGS. 2-4. As used herein, the term "flexible" means pliant, or incapable of retaining any given shape when not subjected to tensile forces. In one or more embodiments, the flexible restraining band 107 may be a flexible cord, tape, or other material that can be bent, folded, coiled, etc. without breaking and can be made to follow a defined path free or substantially free of creases or wrinkles when placed under tension.

In one or more embodiments, the flexible reflective material 101 has a sufficiently low mechanical stiffness so that it can bend or form to the available volume when stowed, that it does not retain wrinkles or creases that substantially inhibit the required surface profile when deployed, and that it reflects electromagnetic radiation efficiently in the desired operational frequency ranges. In one embodiment, the flexible reflective material 101 is a mesh (e.g., a tricot warp-knit material), with between 10 and 15 openings per inch (OPI), fabricated from gold-plated tungsten wire having a diameter of approximately 0.001 inches.

In one or more embodiments, the flexible reflective material 101 is secured to each rib 103. In one or more embodiments in which the flexible net 102 is employed, the flexible reflective material 101 may be affixed to the flexible net 102. In one or more embodiments, the flexible reflective material 101 may be attached to each of the ribs 103 and/or to the flexible net 102 with any suitable technique or techniques, including, for example, mechanical fasteners, adhesives, and/or stitching. In one embodiment the flexible reflective material 101 may be attached to each of the ribs 103 and/or to the flexible net 102 by stitching with a thread constructed from aramid fiber, for example KEVLAR™ or VECTRAN™.

Figure 6:
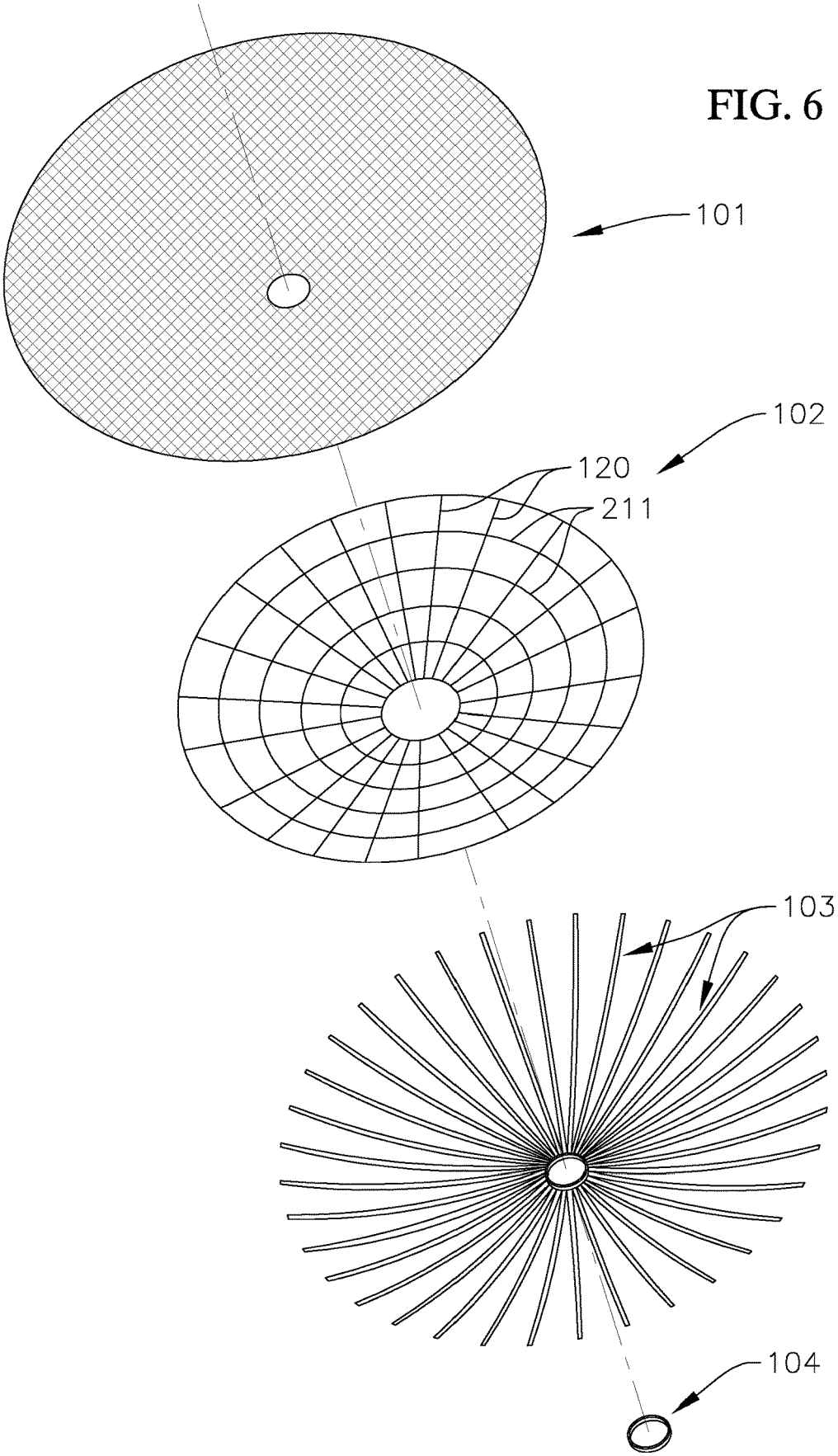
FIG. 6 is an exploded perspective view of a deployed reflector according to one embodiment of the present disclosure including a flexible reflective mesh, a flexible net, ribs, and a central hub.

In one or more embodiments, the parabolic reflector 100 may not include the flexible net 102 (i.e., the flexible net 102 is optional). In one embodiment in which the parabolic reflector 100 includes the flexible net 102, the flexible net 102 is employed and assembled between the plurality of ribs 103 and the flexible reflective material 101, as illustrated in FIG. 6. In one or more embodiments, the flexible net 102 may be assembled such that the flexible reflective material 101 is assembled between the ribs 103 and the flexible net 102. The flexible net 102 is configured (e.g., constructed) to conform to the paraboloidal surface profile formed by the plurality of reflector ribs 103.

Figure 13:
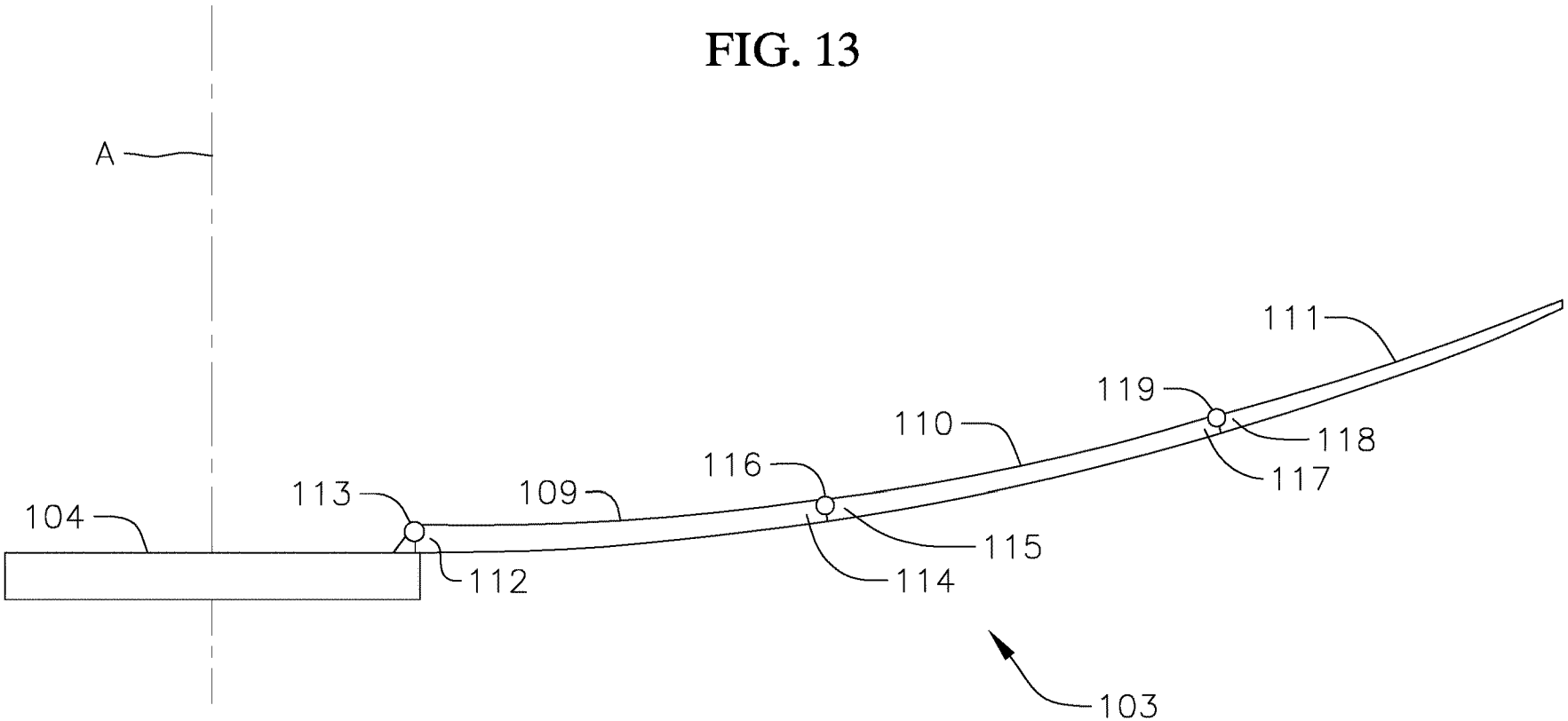
FIG. 13 a side view of a reflector rib, with three rib sections, in the deployed state according to one embodiment of the present disclosure.

In the illustrated embodiment, each rib 103 includes a root rib segment 109 rotatably coupled to the central hub 104, an intermediate rib segment 110 rotatably coupled to the root rib segment 109, and a tip rib segment 111 rotatably coupled to the intermediate rib segment 110. In the illustrated embodiment, a proximal end 112 of the root rib segment 109 is hingedly coupled to the central hub 104 by a first hinge 113, a distal end 114 of the root rib segment 109 opposite the proximal end 112 of the root rib segment 109 is hingedly coupled to a proximal end 115 of the intermediate rib segment 110 by a second hinge 116, and a distal end 117 of the intermediate rib segment 110 opposite to the proximal end 115 of the intermediate rib segment 110 is hingedly coupled to a proximal end 118 of the tip rib segment 111 by a third hinge 119 (e.g., each rib 103 includes three sections or segments 109, 110, 111 rotatably coupled together by precision hinges 113, 116, 119). In the illustrated embodiment, the root rib segment 109, the intermediate rib segment 110, and the tip rib segment 111 of each rib 103 each have a concave profile that follows or substantially follows a parabolic curve. When the root rib segment 109, the intermediate rib segment 110, and the tip rib segment 111 are arranged in the deployed configuration (as illustrated in FIGS. 2, 13, and 15) the concave profile of each rib 103 lies predominantly or substantially predominantly on a single parabolic curve.

Figure 7:
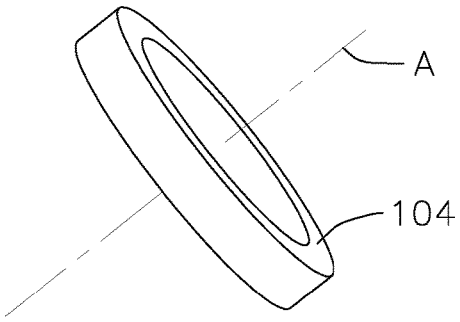
FIG. 7 is a perspective view of the central hub illustrated in FIG. 6 and its coaxial axis.

In the illustrated embodiment, the flexible net 102 is joined to the plurality of root rib segments 109, the intermediate rib segments 110, and the tip rib segments 111 at points distributed along the parabolic curve of each root rib segment 109, intermediate rib segment 110, and tip rib segment 111. In one or more embodiments, the flexible net 102 may be attached to each of the ribs 103 with any suitable technique or techniques, including, for example, mechanical fasteners, adhesives, and/or stitching. In one or more embodiments, the flexible net 102 may be attached to the reflector ribs 103 by stitching with a thread constructed from an aramid fiber, for example KEVLAR™ or VECTRAN™. In the embodiment illustrated in FIG. 6, the flexible net 102 includes a series of radial tension members 120 and a series of transverse tension members 121 crossing the radial tension members 120. In the illustrated embodiment, the radial tension members 120 are aligned or substantially aligned with the ribs 103 and extend along a lengthwise direction of the ribs 103. In the illustrated embodiment, the transverse tension members 121 of the flexible net 102 extend transversely between adjacent ribs 103. In one or more embodiments, the tension members 120, 121 of the flexible net 102 are inextensible or substantially inextensible, and therefore have a higher stiffness than the woven wire mesh utilized, in one or more embodiments, as the flexible reflective material 101. One function of the flexible net 102 is to be the primary load path in the event that, during deployment or stowage of the reflector 100, one rib 103 becomes substantially more deployed or retracted than the adjacent ribs 103. In such a condition, the flexible net 102 will come into tension, acting as the primary load path, and prevent significant loading which might damage the more delicate flexible reflective material 101. Another function of the flexible net 102 is to form a tension structure between adjacent ribs 103 when the reflector 100 is in the deployed configuration. When tensioned by the ribs 103, the flexible net 102 is configured to prevent lateral buckling of the ribs 103 by distributing tangential loads between adjacent ribs 103. Additionally, the flexible net 102 is configured to reduce deflection of the ribs 103 due to acceleration along the axis A (see FIG. 7) of the central hub 104. The tension members 120, 121, which form the flexible net 102, may be constructed from a variety of substantially inextensible flexible materials as required to suit the application. For example, in one or more embodiments, the tension members 120, 121 of the flexible net 102 may be threads, cords, and/or tapes (e.g., threads, cords, and/or tapes composed of aramid fibers or quartz fibers).

In one or more embodiments, the reflector 100 may include thirty-six (36) ribs 103. In the illustrated embodiment, the ribs 103 are uniformly or substantially uniformly spaced around the central hub 104 (e.g., uniformly or substantially uniformly arranged around a circumference of the central hub 104). In one or more embodiments, the reflector 100 may include any other suitable number of ribs 103 (e.g., fewer than 36 ribs 103 or greater than 36 ribs 103). Increasing the number of ribs 103 is configured to improve the approximation of a paraboloidal surface section formed by the flexible reflective material 101 and thereby improve the gain, directivity, and efficiency of any antenna system employing the reflector 100. In one or more embodiments, all ribs 103 must successfully deploy for the reflector 100 to function as intended. Therefore, in one or more embodiments, reducing the number of ribs 103 is configured to improve the reliability that the reflector 100 will properly deploy from the stowed configuration (shown in FIGS. 5, 12, and 14) to the deployed configuration (shown in FIGS. 2-4). In one or more embodiments, the number of ribs 103 may be selected to reach a balance between the deployment reliability and surface profile of the reflector 100.

Figure 8A:
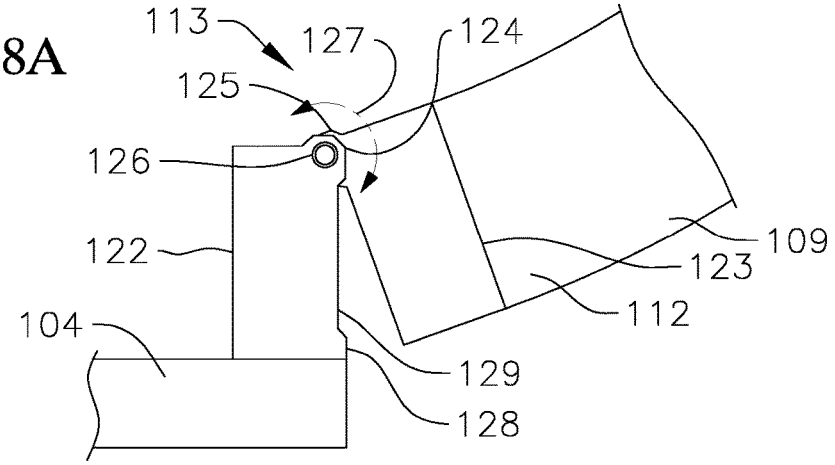
FIGS. 8A-8C are side views of hinges according to one embodiment of the present disclosure.

With reference now to the embodiment illustrated in FIG. 8A, each of the first hinges 113, which rotatably couple the root rib segments 109 of the ribs 103 to the central hub 104, include a hinge clevis 122 coupled to the central hub 104 and a hinge lug 123 coupled to the proximal end 112 of one of the root ribs 109. In one or more embodiments, the hinge lug 123 may be coupled to the central hub 104 and the hinge clevis 122 may be coupled to the proximal end 112 of the root rib segment 109. Additionally, in the illustrated embodiment, the hinge clevis 122 of the first hinge 113 is mounted on a surface of the central hub 104, and is secured with machine screws which preload a mounting interface between the hinge clevis 122 and central hub 104. In one or more embodiments, the hinge clevis 122 or the hinge lug 123 of the first hinge 113 may be coupled to the central hub 104 in any other suitable manner. In other embodiments, features which are equivalent or substantially equivalent to the hinge clevis 122 may be incorporated into the central hub 104 to reduce the quantity of individual components in the design (e.g., the hinge clevis 122 may be integral with the central hub 104).

Additionally, in the embodiment illustrated in FIG. 8A, the hinge clevis 122 is rotatably coupled to the hinge lug 123. The hinge clevis 122 may be rotatably coupled to the hinge lug 123 in any suitable manner. In the illustrated embodiment, the hinge clevis 122 includes a pair of spaced apart tangs 124 and the hinge lug 123 includes a pair of spaced apart tangs 125 that are configured to extend between the tangs 124 of the hinge clevis 122. Additionally, in the illustrated embodiment, each of the tangs 124 of the hinge clevis 122 includes an opening (e.g., a hole) and each of the tangs 125 of the hinge lug 123 include an opening (e.g., a hole) configured to align with the openings in the tangs 124 of the hinge clevis 122.

The first hinge 113 also includes a pin 126 extending through the aligned openings in the tangs 124, 125 of the hinge clevis 122 and the hinge lug 123 and thereby rotatably coupling the hinge clevis 122 to the hinge lug 123. The pin 126 may be retained in the openings in the tangs 124, 125 in any suitable manner. In one or more embodiments, the pin 126 is retained using a roll pin inserted into a hole, with an interference fit, located on the hinge lug 123 or hinge clevis 122 such that the pin 126 engages a notch feature on the pin 126 joining the hinge lug 123 and hinge clevis 122. In other embodiments, the pin 126 may be retained with a fastener such as machine screw. Once the pin 126 is inserted into the openings in the tangs 124, 125, the only substantial degree of freedom in which the hinge lug 123 can move, relative to the hinge clevis 122, is rotation (see arrow 127 in FIG. 8A) about the axis of the pin 126. In the illustrated embodiment, motion of the hinge lug 123 relative to the hinge clevis 122, along the axis of the pin 126, is restricted by the tangs 125 on the hinge lug 123 that are located between the two tangs 124 of the hinge clevis 122 when the first hinge 113 is assembled. In one or more embodiments, the degrees of freedom of the first hinge 113 are substantially similar to those of a revolute joint.

In the embodiment illustrated in FIG. 8A, the hinge clevis 122 of the first hinge 113 also includes a stop surface 128 that is offset from the longitudinal axis of the hinge pin 126. In the illustrated embodiment, the stop surface 128 is proximate to the central hub 104 (e.g., the stop surface 128 may be on the surface of the central hub 104 to which the hinge clevis 122 is coupled). The stop surface 128 is configured to contact (e.g., abut) the hinge lug 123, and thereby limit further rotation (arrow 127) of the hinge lug 123 relative to the hinge clevis 122, when the first hinge 113 is in the fully deployed position. In the illustrated embodiment, the stop surface 128 is defined by a cutout (e.g., a notch) 129 in the hinge clevis 122. That is, material is removed from the hinge clevis 122 which would otherwise be coincident to a surface of the hinge lug 123 when the first hinge 113 is in the deployed position. In the illustrated embodiment, only the stop surface 128 is configured to halt the deployment motion of the hinge lug 123 relative to the hinge clevis 122. The first hinge 113 will therefore deploy to a fixed and repeatable position in a reliable manner and in which the stop surface 128 of the clevis 122 is coincident to (e.g., abutting) a surface on the hinge lug 123.

In one or more embodiments, a latch may be incorporated into the first hinge 113, which will engage when the hinge lug 123 and the stop surface 128 of the hinge clevis 122 are coincident, and which prevents further rotation (arrow 127) of the hinge lug 123 once the hinge 113 reaches the fully deployed position. The latch may have any suitable configuration. In one or more embodiments, the latch may have any suitable configuration known to persons of ordinary skill in the art of latches and/or deployable mechanisms.

Figure 8B:
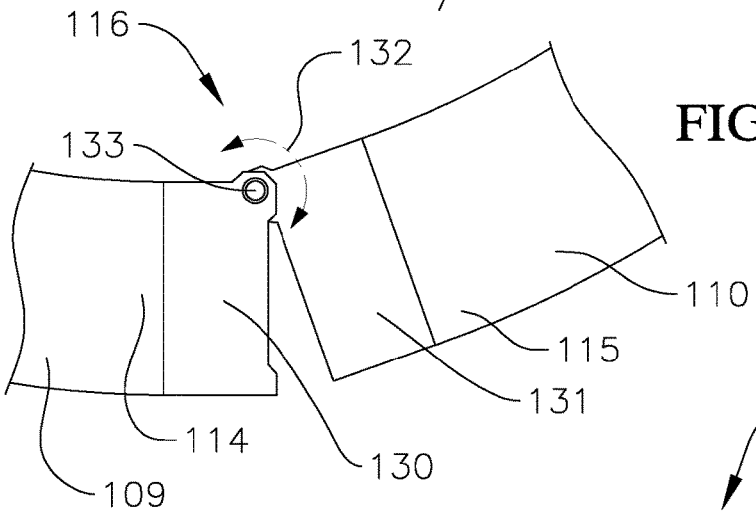

With reference now to the embodiment illustrated in FIG. 8B, each of the second hinges 116, which rotatably couple the intermediate rib segments 110 to the root rib segments 109, include a hinge clevis 130 coupled to the distal end 114 of the root rib segment 109 and a hinge lug 131 coupled to the proximal end 115 of the intermediate rib segment 110. In one or more embodiments, the hinge lug 131 may be coupled to the distal end 114 of the root rib segment 109 and the hinge clevis 130 may be coupled to the proximal end 115 of the intermediate rib segment 110. Accordingly, in one or more embodiments, each of the ribs 103 may include hinge clevises 122, 130 at the proximal end 112 and the distal end 114 of the root rib segment 109, or each of the ribs 103 may include the hinge clevis 122 at the proximal end 112 and the hinge lug 131 at the distal end 114 of the root rib segment 109, or each of the ribs 103 may include the hinge lugs 123, 131 at the proximal end 112 and the distal end 114 of the root rib segment 109, or each of the ribs 103 may include the hinge lug 123 at the proximal end 112 and the hinge clevis 130 at the distal end 114 of the root rib segment 109. Additionally, in the illustrated embodiment, the hinge clevis 130 is rotatably coupled (arrow 132) to the hinge lug 131 with a pin 133. In one or more embodiments, the configurations of the hinge clevis 130 and the hinge lug 131 may be the same as or similar to the configurations of the hinge clevis 129 and the hinge lug 123, respectively, described above with reference to FIG. 8A.

Figure 8C:
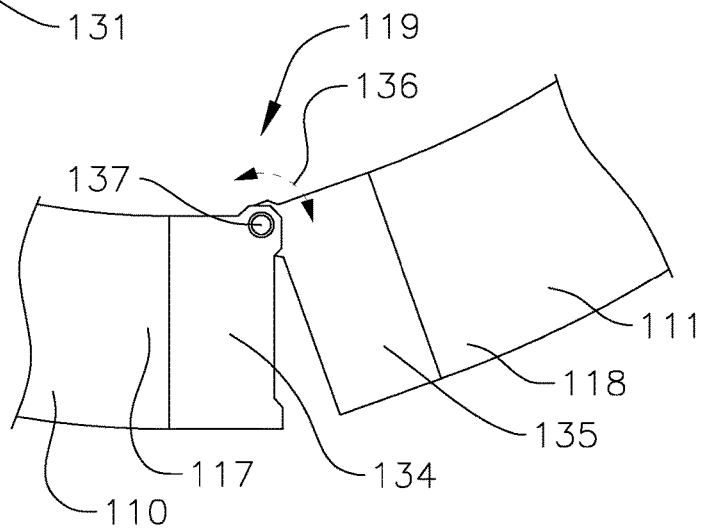

With reference now to the embodiment illustrated in FIG. 8C, each of the third hinges 119, which rotatably couple the tip rib segments 111 to the intermediate rib segments 110, include a hinge clevis 134 coupled to the distal end 117 of the intermediate rib segment 110 and a hinge lug 135 coupled to the proximal end 118 of the tip rib segment 111. In one or more embodiments, the hinge lug 135 may be coupled to the distal end 117 of the intermediate rib segment 110 and the hinge clevis 134 may be coupled to the proximal end 118 of the tip rib segment 111. Accordingly, in one or more embodiments, each of the ribs 103 may include hinge clevises 130, 134 at the proximal end 115 and the distal end 117 of the intermediate rib segment 110, or each of the ribs 103 may include the hinge clevis 130 at the proximal end 115 and the hinge lug 135 at the distal end 117 of the intermediate rib segment 110, or each of the ribs 103 may include the hinge lugs 131, 135 at the proximal end 115 and the distal end 117 of the intermediate rib segment 110, or each of the ribs 103 may include the hinge lug 131 at the proximal end 115 and the hinge clevis 134 at the distal end 117 of the intermediate rib segment 110. Additionally, in the illustrated embodiment, the hinge clevis 134 is rotatably coupled (arrow 136) to the hinge lug 135 with a pin 137. In one or more embodiments, the configurations of the hinge clevis 134 and the hinge lug 135 may be the same as or similar to the configurations of the hinge clevis 129 and the hinge lug 123, respectively, described above with reference to FIG. 8A.

Figure 9:
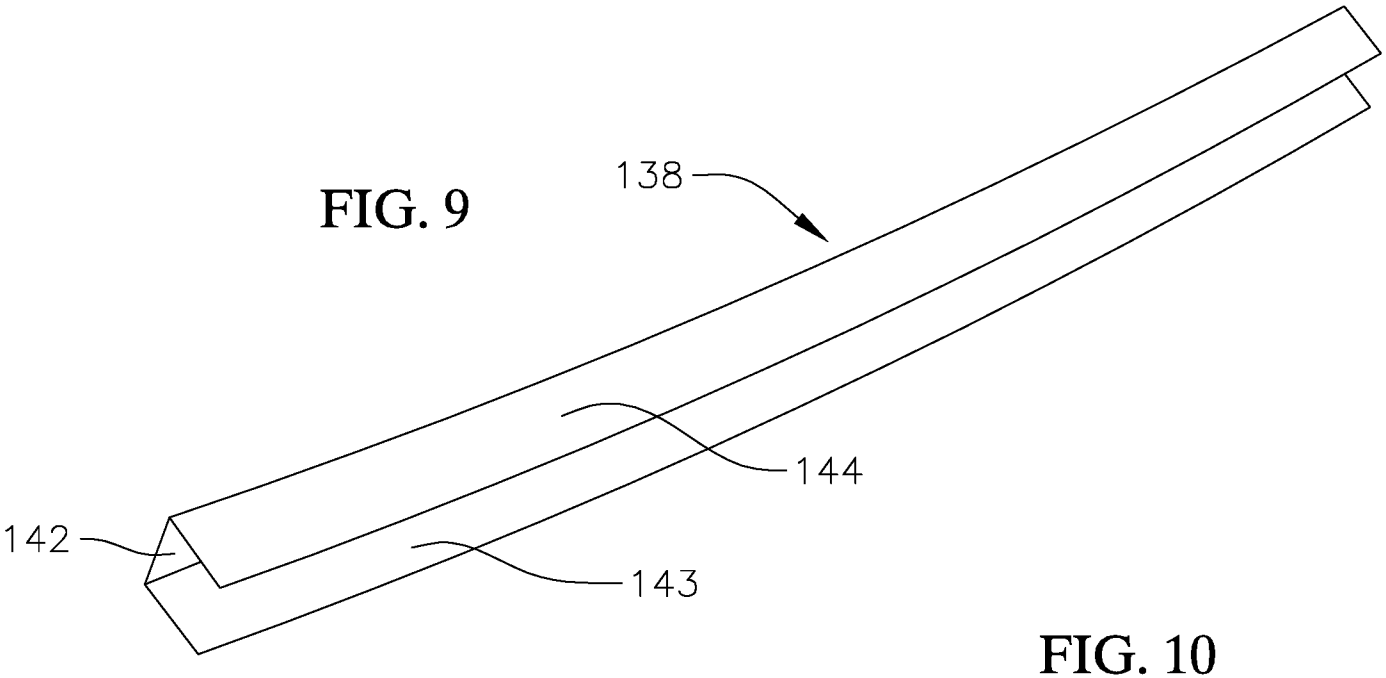
FIG. 9 illustrates a rib beam according to one embodiment of the present disclosure.
Figure 10:
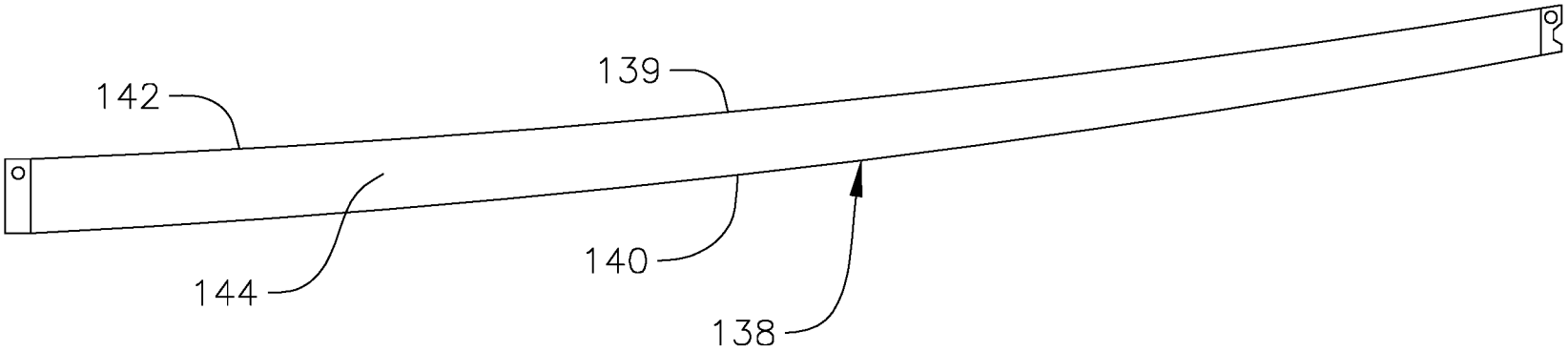
FIG. 10 illustrates a rib section according to one embodiment of the present disclosure.

In the embodiment illustrated in FIGS. 9-10, the root rib segment 109, the intermediate rib segment 110, and the tip rib segment 111 are each a beam 138 having a parabolic curve on a concave side 139 of the beam 138 and a taper on a convex side 140 of the beam 138. The taper on the convex side 140 of the beam 138 is configured to minimize or at least reduce the mass of the beam 138 while maintaining rigidity of the deployed rib segment 109, 110, 111. A suitable material for construction of the root rib segment 109, the intermediate rib segment 110, and the tip rib segment 111 is a graphite fiber reinforced polymer (GFRP). In one or more embodiments, the root rib segment 109, the intermediate rib segment 110, and the tip rib segment 111 may be made from any other suitable material or materials. The process of constructing components from GFRP is well known to those familiar in the art of developing structures for spacecraft and satellites. The fiber layup of the GFRP material may be constructed so that the cured GFRP material exhibits a near zero CTE (coefficient of thermal expansion), thereby greatly reducing, relative to other common materials such as aluminum, structural deformation due to thermal loading. In some embodiments alternative materials, for example a fiberglass reinforced polymer, may be used for or incorporated into the beams 138 of the root rib segment 109, the intermediate rib segment 110, and the tip rib segment 111. In the illustrated embodiment, the beam 138 includes a transverse member 142 and a pair of flanges 143, 144 extending from opposite ends of the transverse member 142. In the illustrated embodiment, the transverse member 142 defines the convex side 140 of the beam 138 having the parabolic curve. In the illustrated embodiment, the beam 138 has a U-shaped cross-sectional shape. In one or more embodiments, the beam 138 may have any other suitable cross-sectional shape. Additionally, in one or more embodiments, the beam 138 is perforated along the transverse member 142 (e.g., parabolic surface) so that stitching may easily be passed through the perforations when affixing the flexible net 102 and/or the flexible reflective material 101 to the ribs 103. In some embodiments, perforations are provided along other surfaces of the beam 138 to facilitate the attachment of other hardware, for example, insulated electrical wires which may pass down the length of one or more of the ribs 103 to reach the HDRM 108.

The hinges 113, 116, 119 may be coupled to the central hub 104, the root rib segment 109, the intermediate rib segment 110, and the tip rib segment 111 in any suitable manner. In one or more embodiments, hinge clevis 122 and the hinge lug 123 of the first hinge 113 may be bonded with an adhesive to the central hub 104 and the proximal end 112 of the root rib segment 109, respectively. In the illustrated embodiment, the hinge clevis 130 and the hinge lug 131 of the second hinge 116 may be bonded with an adhesive to the distal end 114 of the root rib segment 109 and the proximal end 115 of the intermediate rib segment 110, respectively. Additionally, in the illustrated embodiment, the hinge clevis 134 and the hinge lug 135 of the third hinge 119 may be bonded with an adhesive to the distal end 117 of the intermediate rib segment 110 and the proximal end 118 of the tip rib segment 111, respectively. In one or more embodiments, to produce the one or more adhesive bonds between the hinge lugs 123, 131, 135, the hinge clevises 122, 130, 134, the central hub 104, and the rib segments 109, 110, 111, a manufacturing support fixture is employed which controls the relative alignment between the components to be joined together (e.g., a fixture that controls the relative alignment between hinge lugs 123, 131, 135, the hinge clevises 122, 130, 134, the central hub 104, and the rib segments 109, 110, 111). This alignment of the components to be joined together is rigidly maintained by the fixture while the adhesive cures to form a solid bond with high stiffness between the adjacent components. Adhesive may be applied before or after placing components on the fixture. In one or more embodiments, the adhesive is a structural epoxy. In one or more embodiments, the surfaces of the components to be bonded together must be prepared, for example by abrasion and cleaning, to ensure proper adhesion of the adhesive to the components which are to be joined. In other embodiments, alternative methods may be employed to join the hinge lugs 123, 131, 135 and the hinge clevises 122, 130, 134 to the central hub 104 and the rib segments 109, 110, 111, for example mechanical fasteners such as machine screws or rivets. In one or more embodiments, the hinges 113, 116, 119 may be incorporated integrally (e.g., by additive manufacturing techniques) into the beams 138 of the root rib segment 109, the intermediate rib segment 110, and the tip rib segment 111, thereby obviating the need for multiple components, alignment fixtures and means of joining the components (e.g., the hinge lug 123 may be integrally formed with the proximal end 112 of the root rib segment 109, the hinge clevis 130 may be integrally formed with the distal end 114 of the root rib segment 109, the hinge lug 131 may be integrally formed with the proximal end 115 of the intermediate rib segment 110, the hinge clevis 134 may be integrally formed with the distal end 117 of the intermediate rib segment 110, and the hinge lug 135 may be integrally formed with the proximal end 118 of the root rib 111). In one or more embodiments in which the beams 138 of the root rib segment 109, the intermediate rib segment 110, and the tip rib segment 111 are constructed from GFRP, which exhibits low mass, high stiffness and thermal stability, the fabrication of precision hinges 113, 116, 119 (e.g., the hinge lugs 123, 131, 135 and the hinge clevises 122, 130, 134) may be performed separately and/or from a different material.

In one or more embodiments, each hinge 113, 116, 119 is articulated from the stowed position (see FIG. 5) to the deployed position (see FIGS. 2-4) by a mechanism coupled to an actuator. In one or more embodiments, each of the hinges 113, 116, 119 may be articulated from the stowed position to the deployed position directly by an actuator.

Figure 11:
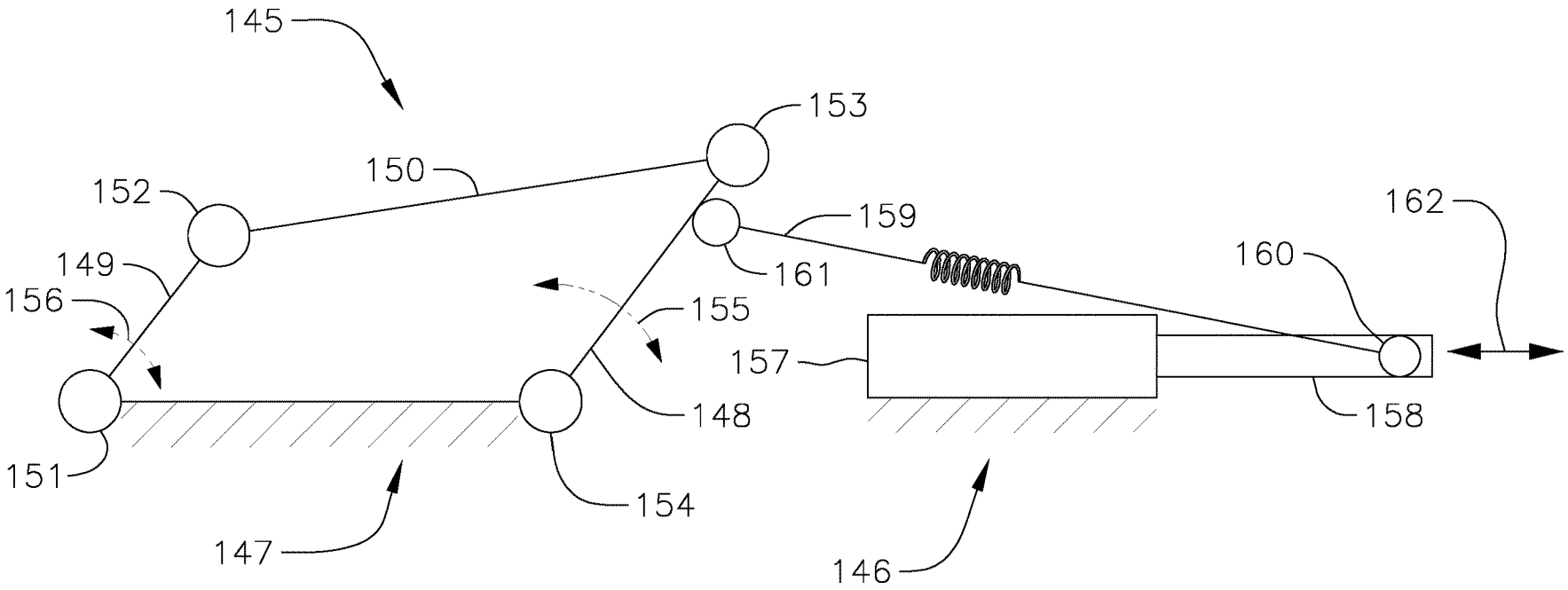
FIG. 11 is a side view of a joint articulation mechanism consisting of a linear actuator joined to a planar quadrilateral linkage according to one embodiment of the present disclosure.

In the embodiment illustrated in FIG. 11, each hinge 113, 116, 119 of each rib 103 is independently articulated (e.g., rotated (arrows 127, 132, 136, respectively, in FIGS. 8A-8C)) by a corresponding planar quadrilateral linkage 145 connected to a linear actuator 146. The design, construction and operation of a planar quadrilateral linkage is known to a person of ordinary skill in the art of developing such mechanisms. The planar quadrilateral linkage 145 includes four links 147, 148, 149, 150 (e.g., a ground link 147, an input link 148, an output link 149, and a floating link 150), as illustrated in FIG. 11. In one embodiment in which the planar quadrilateral linkage 145 is utilized to articulate (e.g., rotate (arrow 127)) the first hinge 113 and the root rib segment 109, the hinge clevis 122 coupled to the central hub 104 forms the ground link 147 and the hinge lug 123 coupled to the proximal end 112 of the root rib segment 109 forms the output link 149 of the planar quadrilateral linkage 145. In one embodiment in which the planar quadrilateral linkage 145 is utilized to articulate (e.g., rotate (arrow 132)) the second hinge 116 and the intermediate rib segment 110, the hinge clevis 130 coupled to the distal end 114 of the root rib segment 109 forms the ground link 147 and the hinge lug 131 coupled to the proximal end 115 of the intermediate rib segment 110 forms the output link 149 of the planar quadrilateral linkage 145. In one embodiment in which the planar quadrilateral linkage 145 is utilized to articulate (e.g., rotate (arrow 132)) the third hinge 119 and the tip rib segment 111, the hinge clevis 134 coupled to the distal end 117 of the intermediate rib segment 110 forms the ground link 147 and the hinge lug 135 coupled to the proximal end 118 of the tip rib segment 111 forms the output link 149 of the planar quadrilateral linkage 145.

The output link 149 is connected to the ground link 147 with a revolute joint 151, and to the floating link 150 with a revolute joint 152. The input link 148 is connected to the floating link 150 with a revolute joint 153, and to the ground link 147 with a revolute joint 154. The dimensions of the four links 147, 148, 149, 150 which comprise each planar quadrilateral linkage 145 are selected such that rotation (arrow 155) of the input link 148 drives the rotation (arrow 156) of the corresponding output link 149 through the necessary range of motion, thereby controlling the position of the corresponding precision hinge 113, 116, 119 and the corresponding rib 109, 110, 111 connected thereto. Motion of the input link 148 is controlled by the corresponding linear actuator 146. A body 157 of the linear actuator 146 is substantially fixed relative to the ground link 147 of the planar quadrilateral linkage 145. A piston 158 of the linear actuator 146 is connected to a drive link 159 with a revolute joint 160. The drive link 159 is connected to the input link 148 of the planar quadrilateral linkage 145 with a revolute joint 161. Motion of the piston 158 displaces the drive link 159 and produces a corresponding rotation (arrow 155) of the input link 148 of the planar quadrilateral linkage 145. Controlled motion of the respective precision hinge 113, 116, 119 and the corresponding rib segment 109, 110, 111 connected thereto may therefore be achieved by controlling the position (arrow 162) of the linear actuator piston 158. In one or more embodiments, the linear actuator 146 is a high output paraffin (HOP) actuator. In one or more embodiments, the linear actuator 146 may be any other suitable type of actuator. A person of ordinary skill in the art will recognize that a wide variety of actuators are available to effect rotary or linear motion. Additionally, in one or more embodiments, the drive link 159 may be made of an extensible material, or may include a spring or other suitable mechanism along the length of the drive link 159, to provide compliance between the motion of the piston 158 and the corresponding motion of the respective hinge 113, 116, 119.

Figure 5:
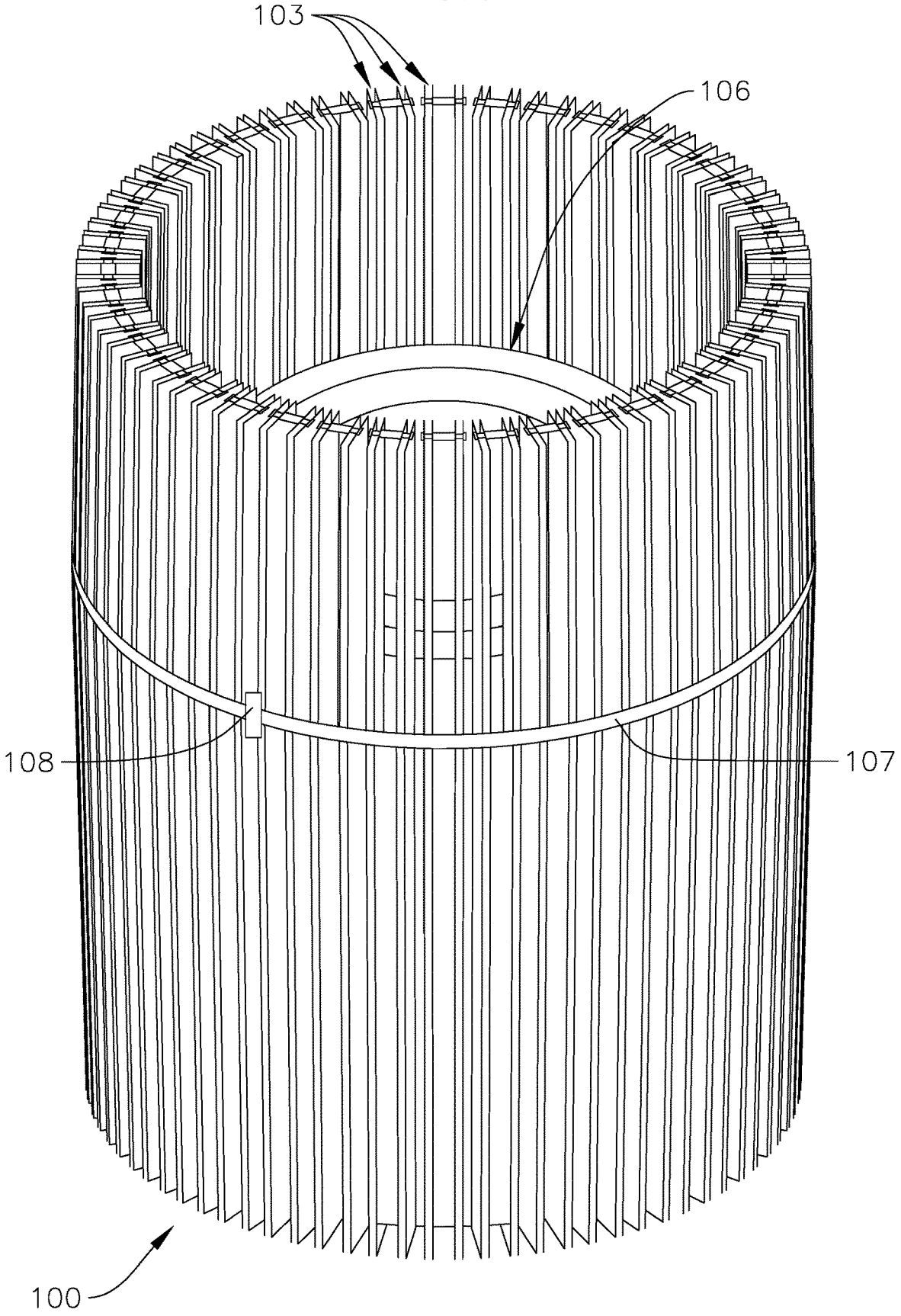
FIG. 5 is a perspective view of a reflector according to one embodiment of the present disclosure in a stowed state restrained with a band held in tension by a hold down and release mechanism, and preloaded against a central cylindrical structure.
Figure 12:
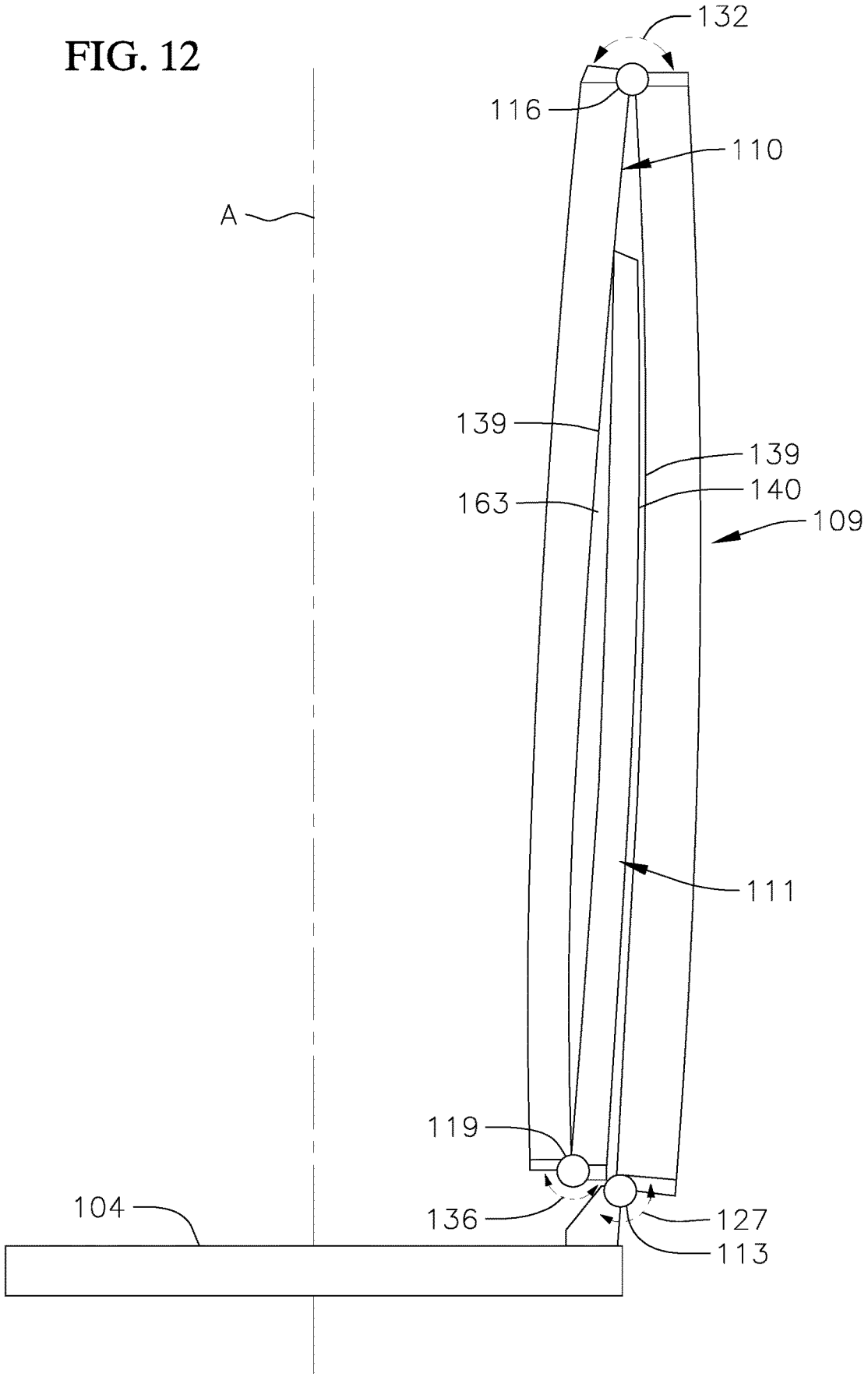
FIG. 12 is a side view of a single reflector rib in the stowed state mounted on the central hub according to one embodiment of the present disclosure.
Figure 14:
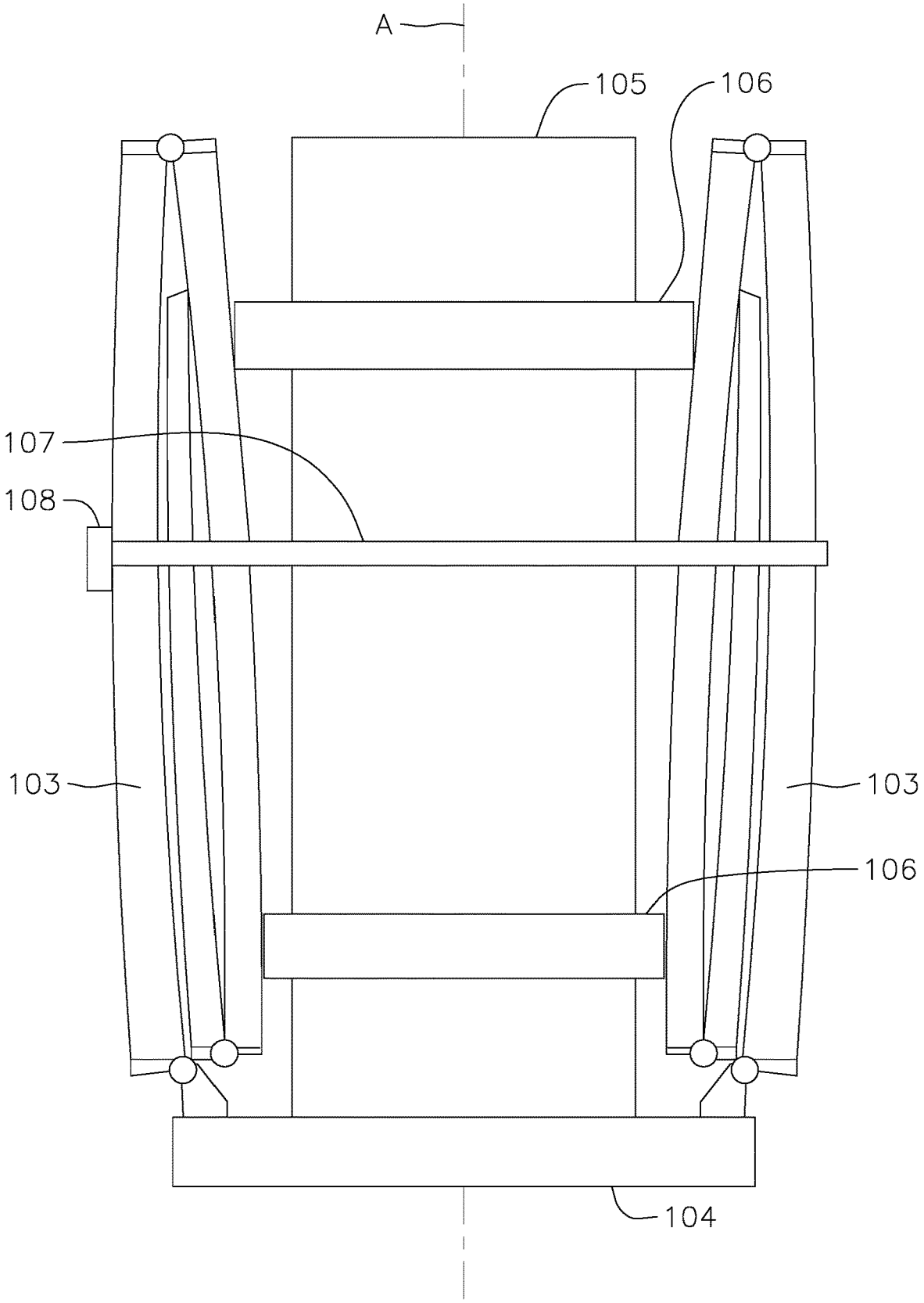
FIG. 14 is a side view of the reflector according to one embodiment of the present disclosure in the stowed configuration, with all but two ribs intentionally hidden from view, and with the flexible reflective material and flexible net intentionally hidden from view, to show detail of the stowed ribs restrained and preloaded against the central cylindrical structure by a flexible band held in tension by a hold down and release mechanism.
Figure 15B:
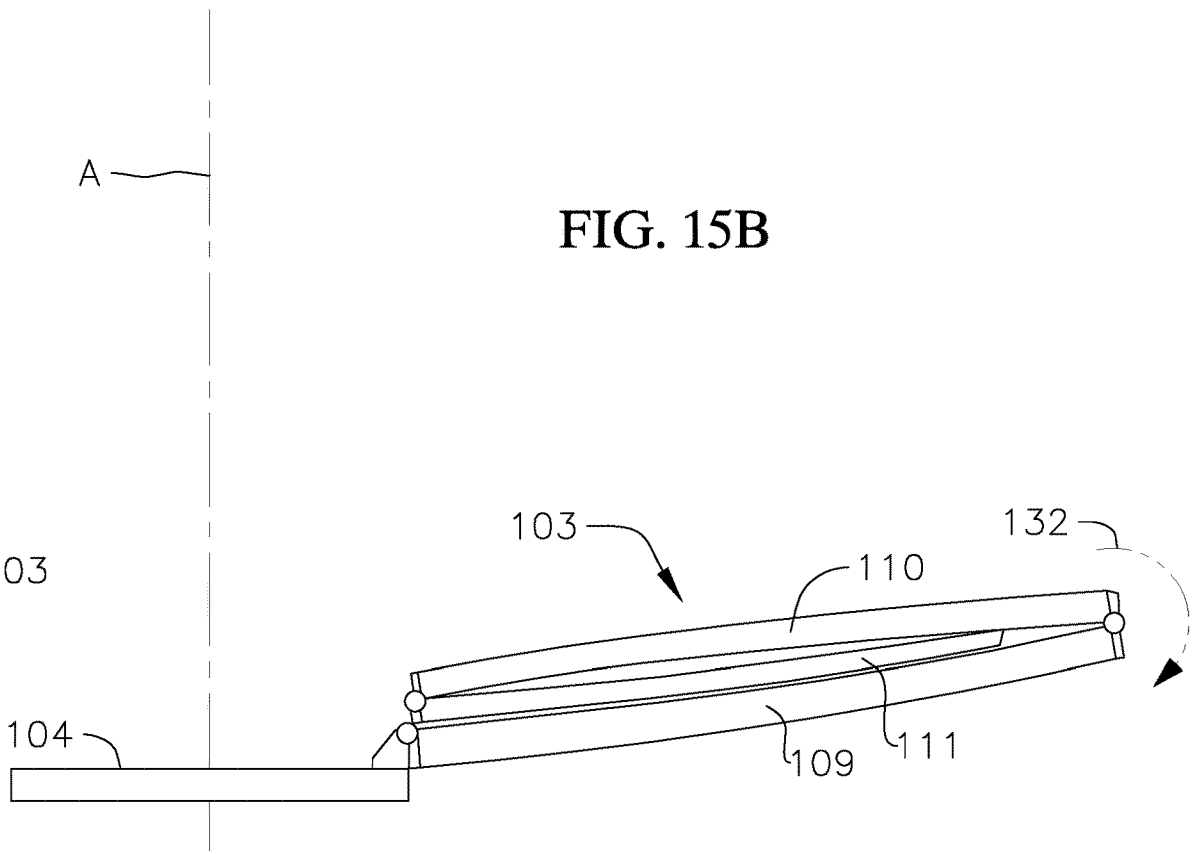
FIGS. 15A-15D are a series of side views depicting a deployment sequence of a reflector rib according to one embodiment of the present disclosure.
Figure 15A:
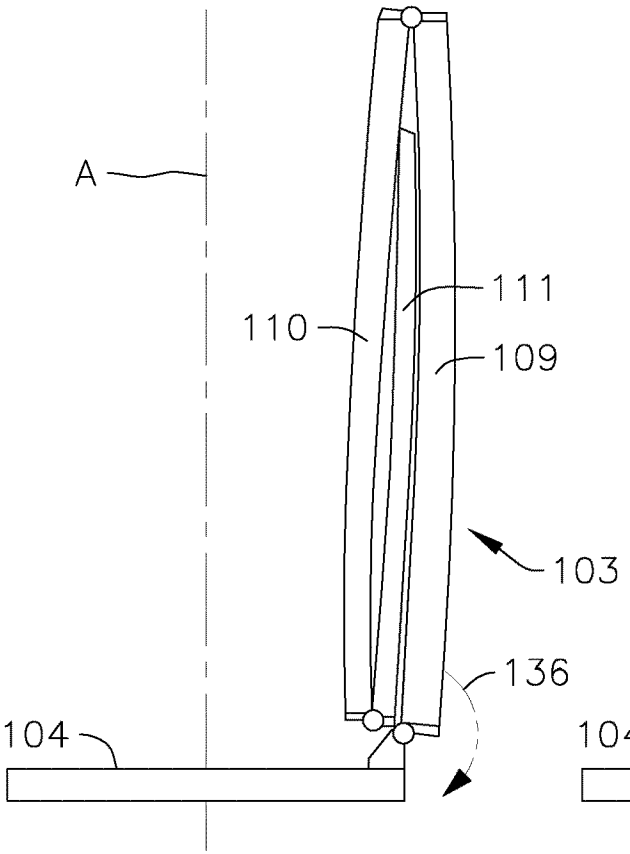
Figure 15C:
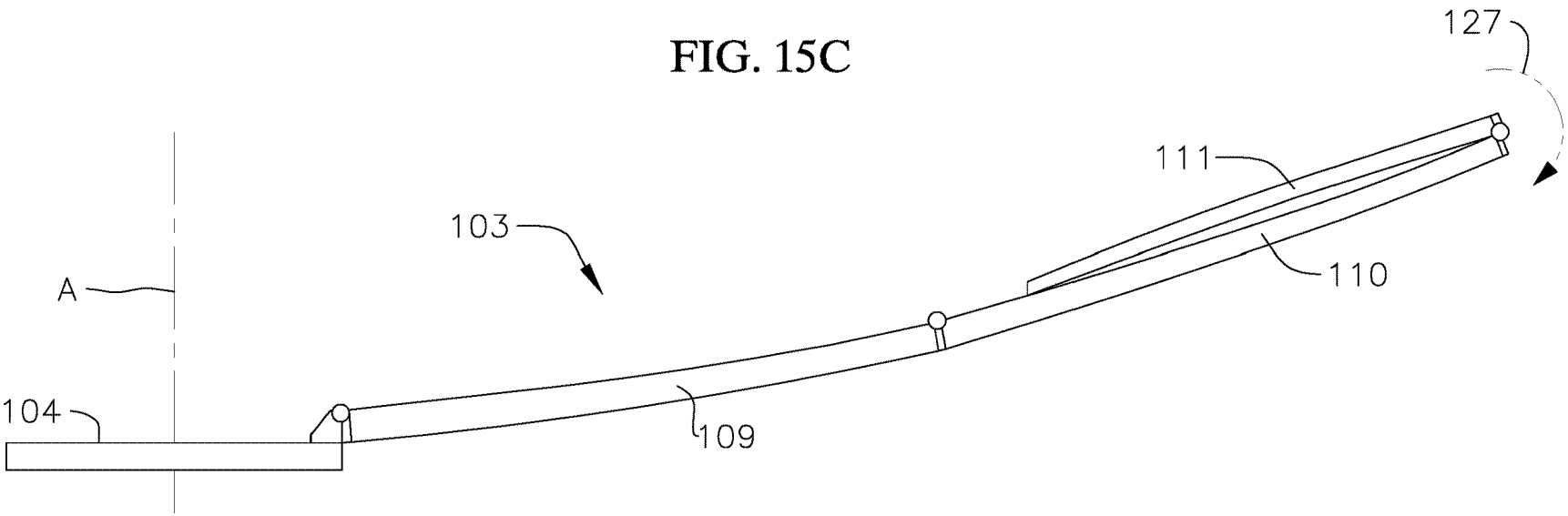
Figure 15D:
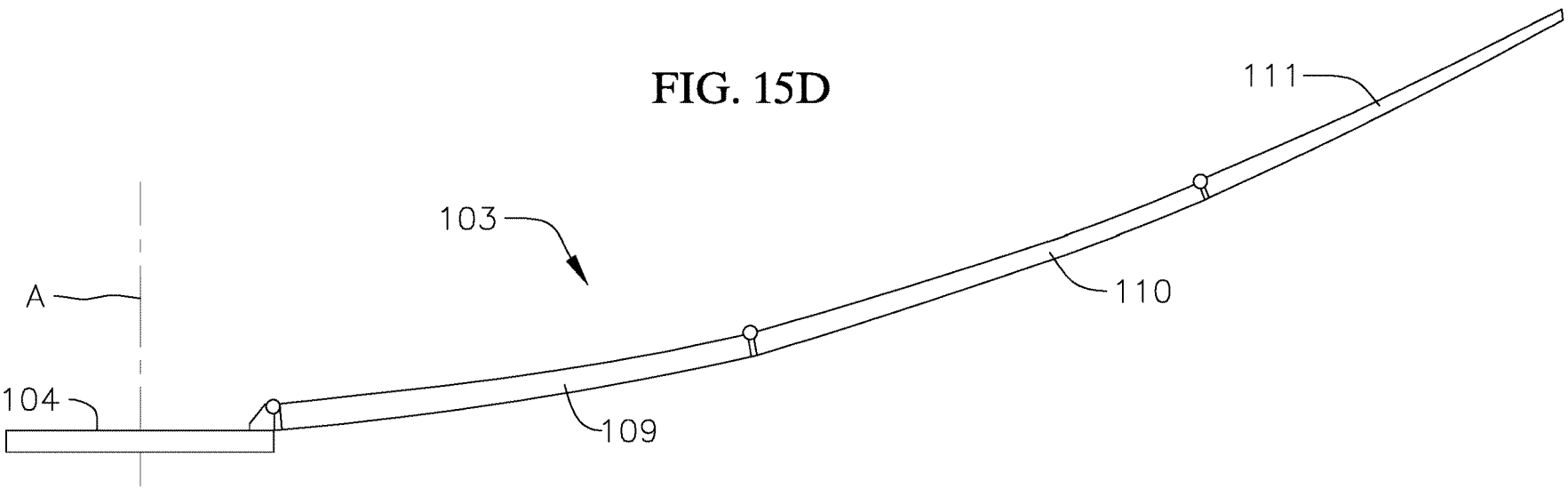

Collapsing the reflector 100 to the stowed configuration, shown in FIGS. 5, 12, and 14, is configured to reduce the stowed volume of the reflector 100 compared to conventional reflectors. In conventional reflector designs with a folding rib, only a single fold is employed. As a result, the minimum stowed antenna height is approximately equivalent to one half the deployed radius of the antenna. The reflector 100 according to one or more embodiments of the present disclosure adds an additional fold to each rib 103, increasing the number of rib sections 109, 110, 111 to three and thus reducing the stowed height of the reflector 100. Accordingly, in one or more embodiments, the minimum stowed height is approximately one third the deployed radius of the reflector 100. Moreover, unlike a conventional articulated radial rib reflector, the plurality of ribs 103 of the present disclosure form the paraboloidal surface to which the flexible reflective material 101 conforms, making a system of standoffs, tension beams, and drop cords required to control the reflective mesh surface of the articulated radial rib reflector unnecessary. This simplifies design, manufacturing, and testing.

The addition of a third rib section (e.g., the intermediate rib segment 110) is not trivial as it must reside within a portion of the already limited stowed volume available for the reflector 100. In the illustrated embodiment of the reflector 100, the tip rib segment 111 section is configured to fold into a space 163 (i.e., a volume) located between the root rib segment 109 section and the intermediate rib segment 110, as the reflector 100 is moved into the stowed configuration shown in FIGS. 5, 12, and 14. FIG. 12 illustrates the stowed rib 103, with three rib sections 109, 110, 111, in which the tip rib segment 111 is located in the space 163 between the root rib segment 109 and the intermediate rib segment 110. This space 163 between the root rib segment 109 section and the intermediate rib segment 110 section is created due to the parabolic curvature of the root rib segment 109 and the intermediate rib segment 110. When the intermediate rib segment 110 is folded so that the concave side 139 of its parabolic form is adjacent to the concave side 139 of the root rib segment 109, as illustrated in FIG. 12, the space 163 is created that may be exploited to house (e.g., enclose) the stowed tip rib segment 111.

In the illustrated embodiment, the convex side 140 of the tip rib segment 111, which is opposite the concave side 139 forming the parabolic curve, is tapered such that it conforms or substantially conforms to the parabolic curvature of the concave side 139 root rib segment 109, which enables the tip rib segment 111 to reside between the root rib segment 109 and the intermediate rib segment 110 when the rib 103 is in the stowed configuration. Tapering the profile of the rib 103 to reduce mass and minimize deflection of deployed ribs 103 in 1 g acceleration conditions will lead to a reasonable approximation for this curvature. Selection of a focal length and aperture diameter will constrain the design space for this taper of the convex side 140 of the tip rib segment 111.

Increasing the ratio of aperture focal length to aperture diameter (commonly referred to as F/D) of the reflector 100, produces less curvature in a parabolic reflector 100, and thus less space in which to stow the tip rib segment 111 when the reflector 100 is in the stowed configuration. Accordingly, in one or more embodiments, there is a limit to the maximum practical F/D that may be selected when designing the reflector 100. Other factors may also constrain the maximum practical F/D of the reflector 100, such as rib 103 stiffness and the size of the mechanical hardware necessary to construct the precision hinges 113, 116, 119 which are incorporated into each rib 103. In the illustrated embodiment, the F/D of the reflector 100 is 0.55 or approximately 0.55.

To move the tip rib segment 111 into the stowed configuration between the root rib segment 109 and the intermediate rib segment 110 as illustrated in FIGS. 5, 12, and 14, the tip rib segment 111 may be first rotated (arrow 136) to the stowed position relative to the intermediate rib segment 110, then the intermediate rib segment 110 may be rotated (arrow 132) to the stowed position relative to the root rib segment 109, and then the root rib segment 109 may be rotated (arrow 127) to the stowed position relative to the axis A of the central hub 104. To deploy the reflector 100, this sequence is reversed so that first the root rib segment 109 is rotated (arrow 127) to the deployed position, then the intermediate rib segment 110 is rotated (arrow 132) to the deployed position, and then the tip rib segment 111 is rotated (arrow 136) to the deployed position. The rib 103 deployment sequence is illustrated in FIGS. 15A-15D, which show a single rib 103 mounted to a central hub 104 and progressing from the stowed configuration (FIG. 15A), to deployment of the root rib segment 109 (FIG. 15B), to deployment of the intermediate rib segment 110 and the root rib segment 109 (FIG. 15C), and finally to the fully deployed configuration (FIG. 15D) in which the root rib segment 109, the intermediate rib segment 110, and the tip rib segment 111 are all deployed. The articulation of the rib 103 during the deployment sequence ensures that the intermediate rib segment 110 and the tip rib segment 111 do not contact any adjacent structure, including for example other ribs 103 or the central structure 105 (see FIG. 4), which could otherwise lead to damage or entanglement thereby preventing deployment.

Figure 16B:
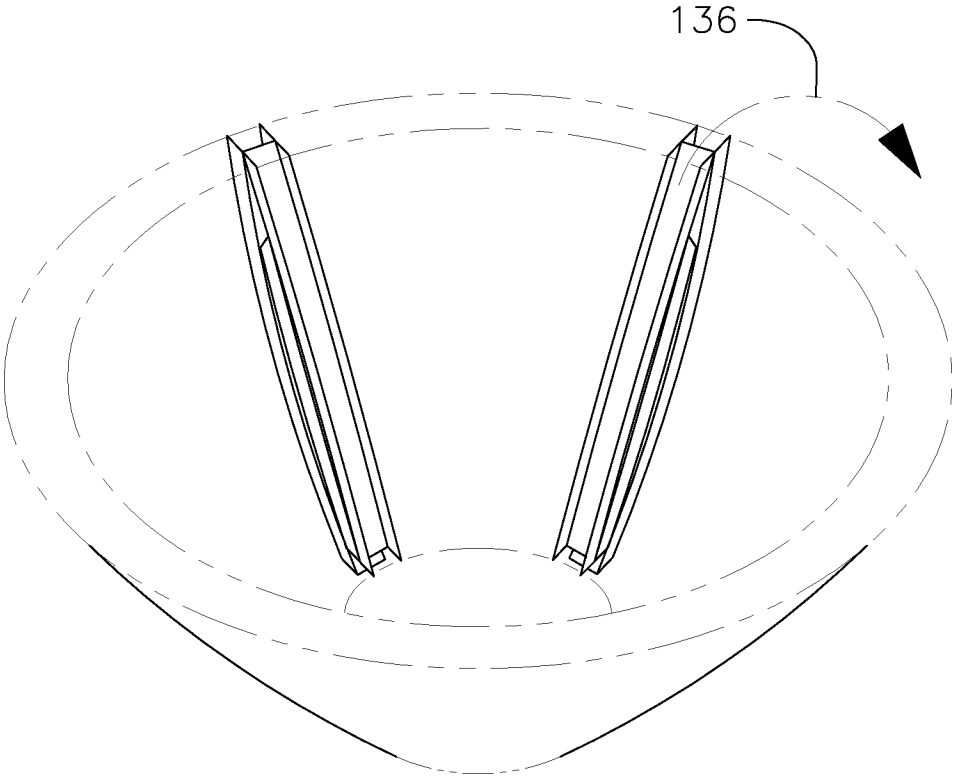
FIGS. 16A-16G are a series of perspective view depicting a deployment sequence of a reflector according to one embodiment of the present disclosure in which the flexible reflective material is not shown.
Figure 16A:
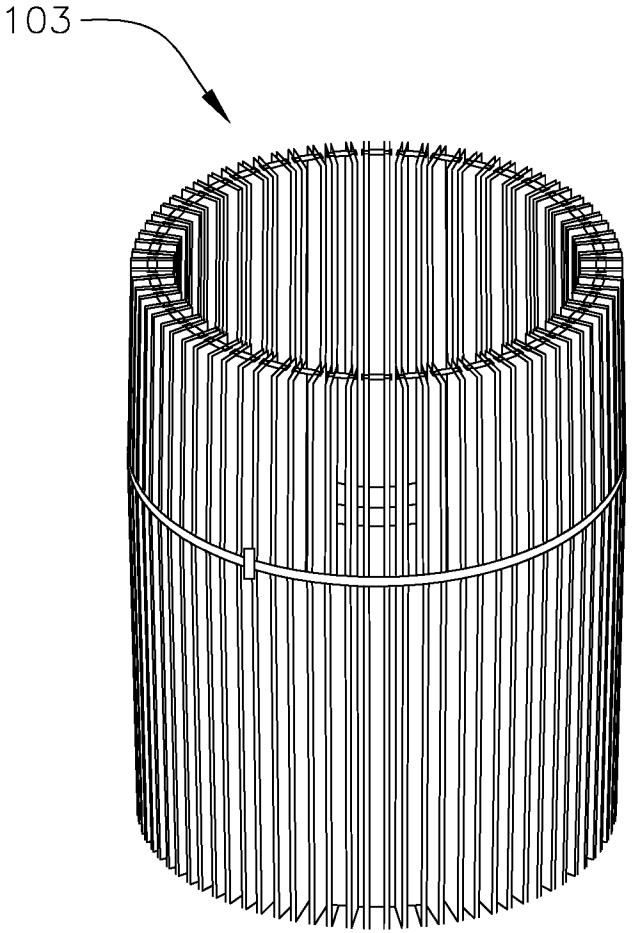
Figures 16C, 16D:
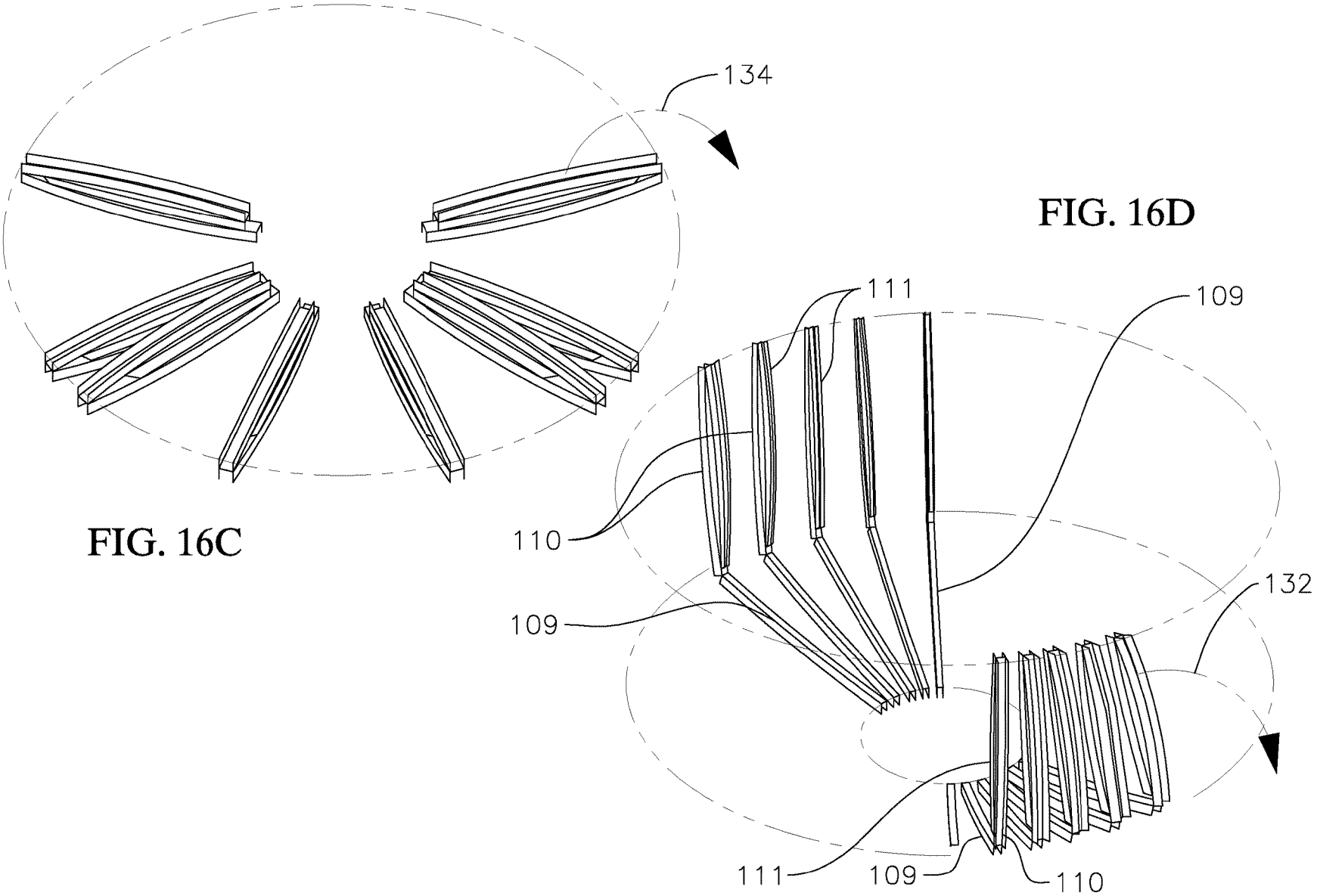
Figure 16E:
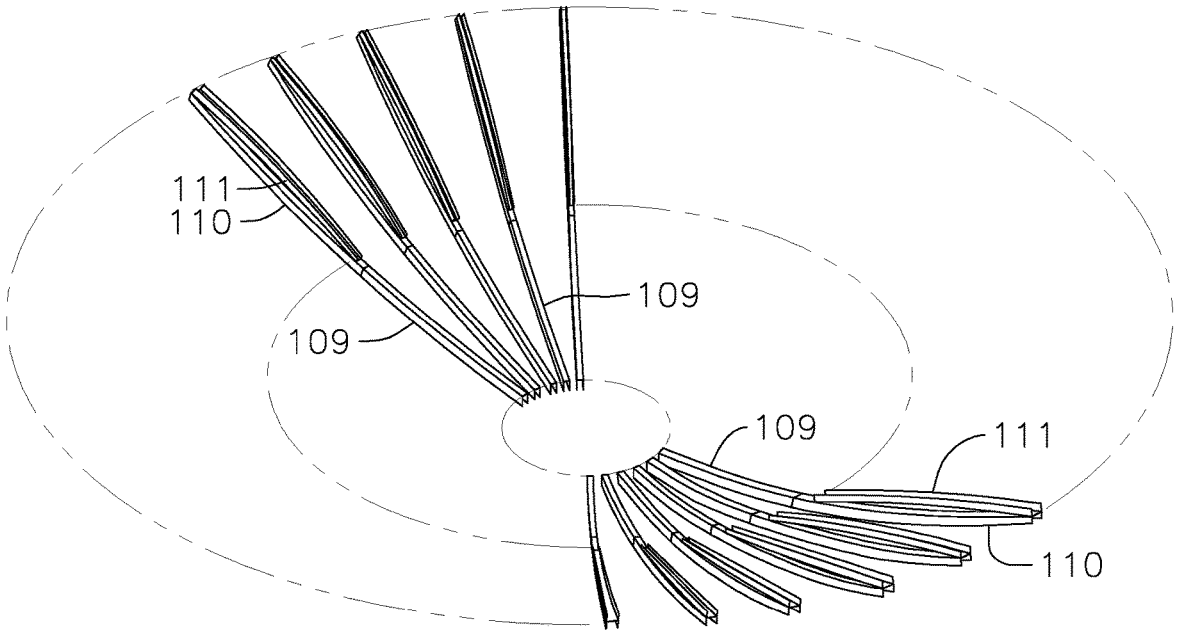
Figure 16F:
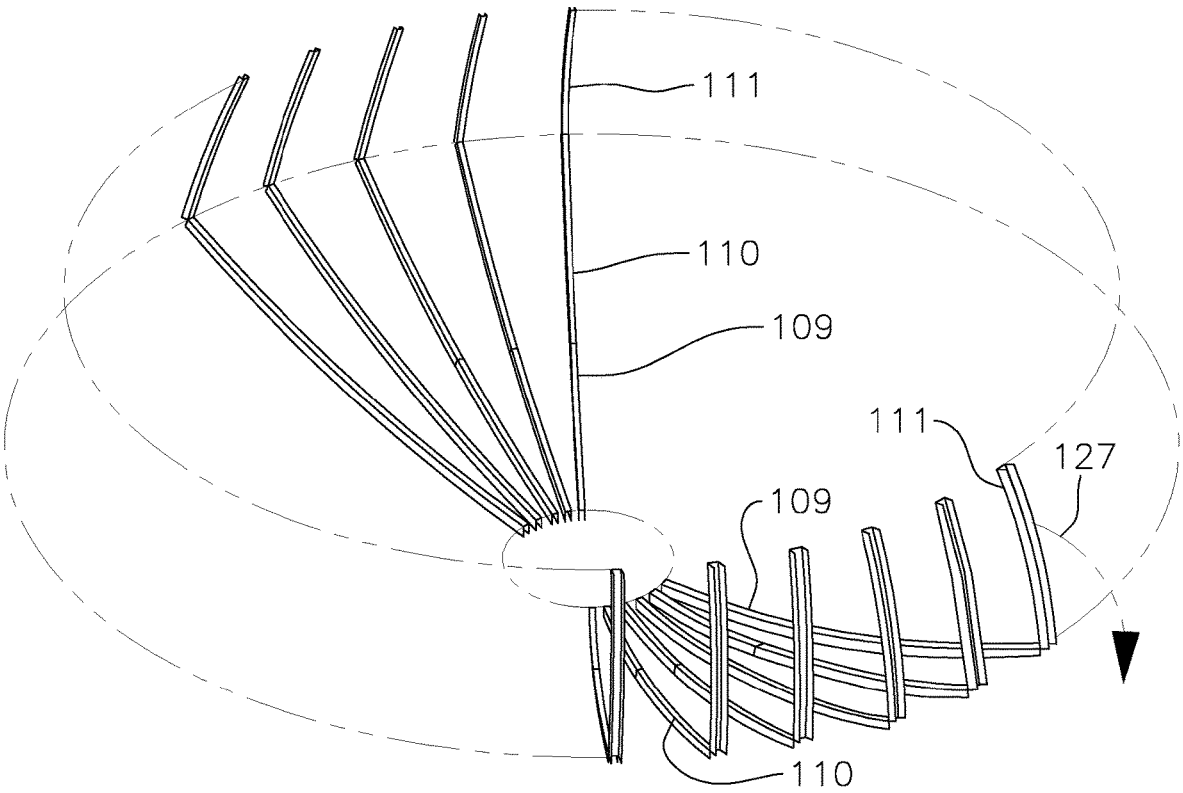
Figure 16G:
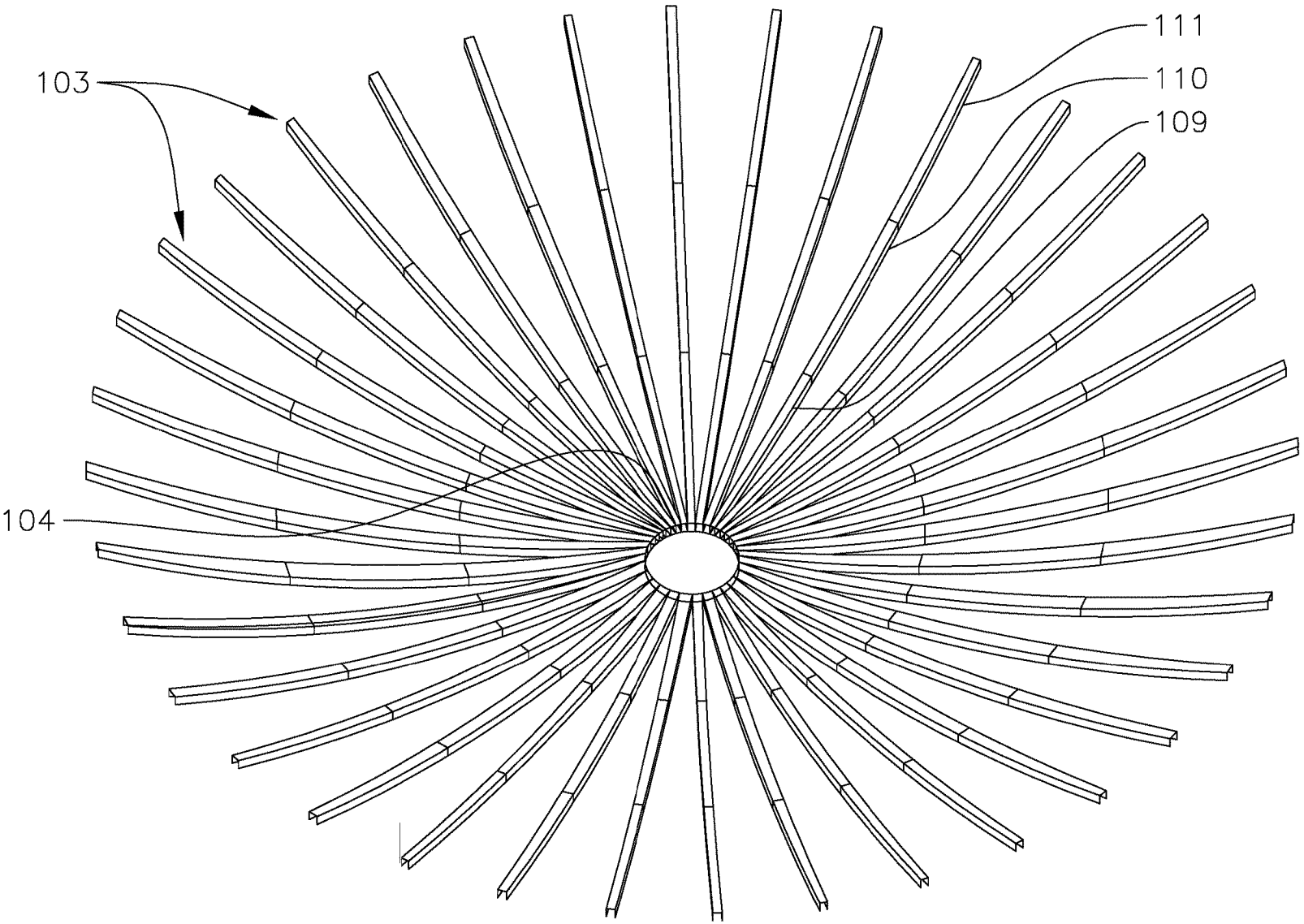

The reflector 100 deployment sequence is illustrated in FIGS. 16A-16G, which for clarity omits all components from view except for the plurality of ribs 103 and the central hub 104. The sequence begins with the reflector 100 in the stowed configuration, as shown in FIG. 16A. Firstly, the plurality of root rib segments 109 are deployed (arrow 136), passing through intermediate positions (FIG. 16B) until their fully deployed positions (FIG. 16C) are reached. Next, the plurality of intermediate rib segments 110 are deployed (arrow 132), passing through intermediate positions (FIG. 16D) until their fully deployed positions (FIG. 16E) are reached. Finally, the plurality of tip rib segments 111 are deployed (arrow 127), passing through intermediate positions (FIG. 16F) until their fully deployed position (FIG. 16G) are reached, at which point the reflector 100 is in the fully deployed configuration.

Deploying the ribs 103 in the aforementioned manner places the flexible reflective material 101 between adjacent rib segments (e.g., between the root rib segment 109 and the intermediate 110, or between the intermediate rib segment 110 and the tip rib segment 111) under an increasing amount of tension as the hinges 113, 116, 119 reach the fully deployed position, which is configured to ensure that the flexible reflective material 101 is displaced from the stop surfaces 128 (see FIG. 8A) located on the precision hinges 113, 116, 119, thereby preventing the flexible reflective material 101 from being captured, entangled, or compressed between the stop surface 128 and the corresponding contact surface on the hinge 113, 116, 119 as they come together during deployment of the precision hinges 113, 116, 119 (e.g., the deployment of the ribs 103 in the manner described above is configured to prevent the flexible reflective material 101 from becoming captured, entangled, or compressed between the stop surface 128 of the hinge clevis 122 and the contact surface of the hinge lug 123 of the first hinge 113, between the stop surface 128 of the hinge clevis 130 and the contact surface of the hinge lug 131 of the second hinge 116, and between the stop surface 128 of the hinge clevis 134 and the contact surface of the hinge lug 135 of the third hinge 119). In contrast, the reflective material in conventional reflector designs in which successive hinges located along a single articulating rib rotate in opposite directions are susceptible to being captured, entangled, and/or compressed.

In the illustrated embodiment, the reflector 100 is secured in the stowed configuration (see FIGS. 5, 12, and 14) to prevent damage due to dynamic loading, for example loading produced by random vibration, acoustic loads, or quasi-static loads from a rocket used to place the reflector 100 into space. In one or more embodiments, to secure the reflector 100 in the stowed configuration, the flexible restraining band 107 is positioned to extend around the circumference of the stowed reflector 100. The flexible restraining band 107 is placed under tension to preload the ribs 103 of the reflector 100 against launch locks 106 (FIG. 14) which are located on the central structure 105. The design and employment of launch lock features are known to a person of ordinary skill in the art familiar with designing deployable mechanisms for spacecraft.

In one or more embodiments, the flexible restraining band 107 is an aramid tape between 0.5 inch and 1.0 inch in width. In one or more embodiments, the flexible restraining band 107 is secured by the HDRM 108 so that tension is maintained in the flexible restraining band 107. When the HDRM 108 is activated, the tension in the flexible restraining band 107 is released, eliminating the radial loads which preload the stowed ribs 103 against the launch locks 106, and allowing the reflector 100 to be deployed. In one or more embodiments, the HDRM 108 is an electrically actuated thermal knife. To actuate the HDRM 108, an electrical current is applied to the device, which heats a resistive element. When the resistive element has reached a sufficient temperature, it severs the flexible restraining band 107, which is routed through a portion of the HDRM 108, thereby releasing tension in the flexible restraining band 107.

Figure 17A:
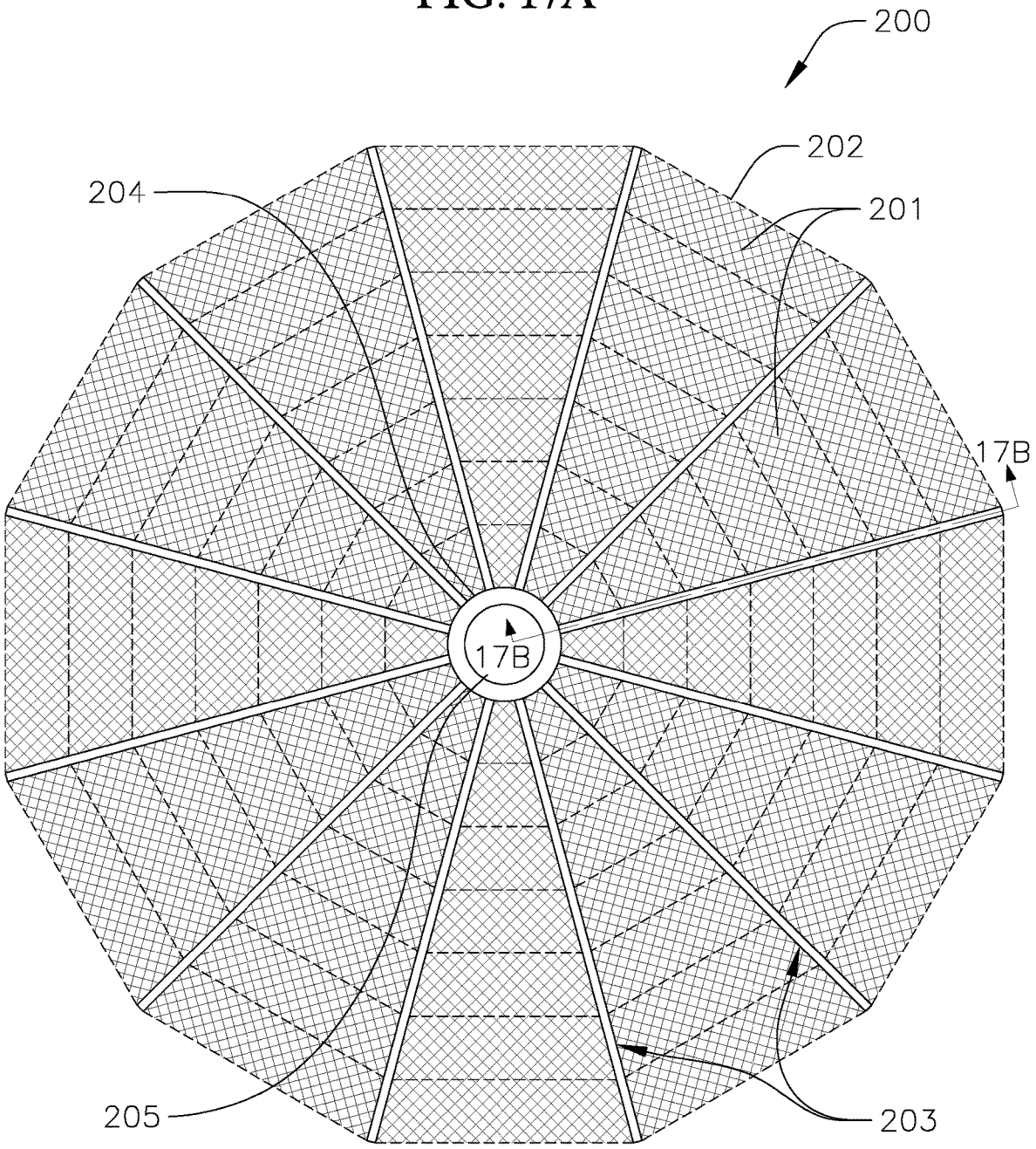
FIG. 17A is a top view of a parabolic antenna reflector according to another embodiment of the present disclosure in a deployed configuration.
Figure 17B:
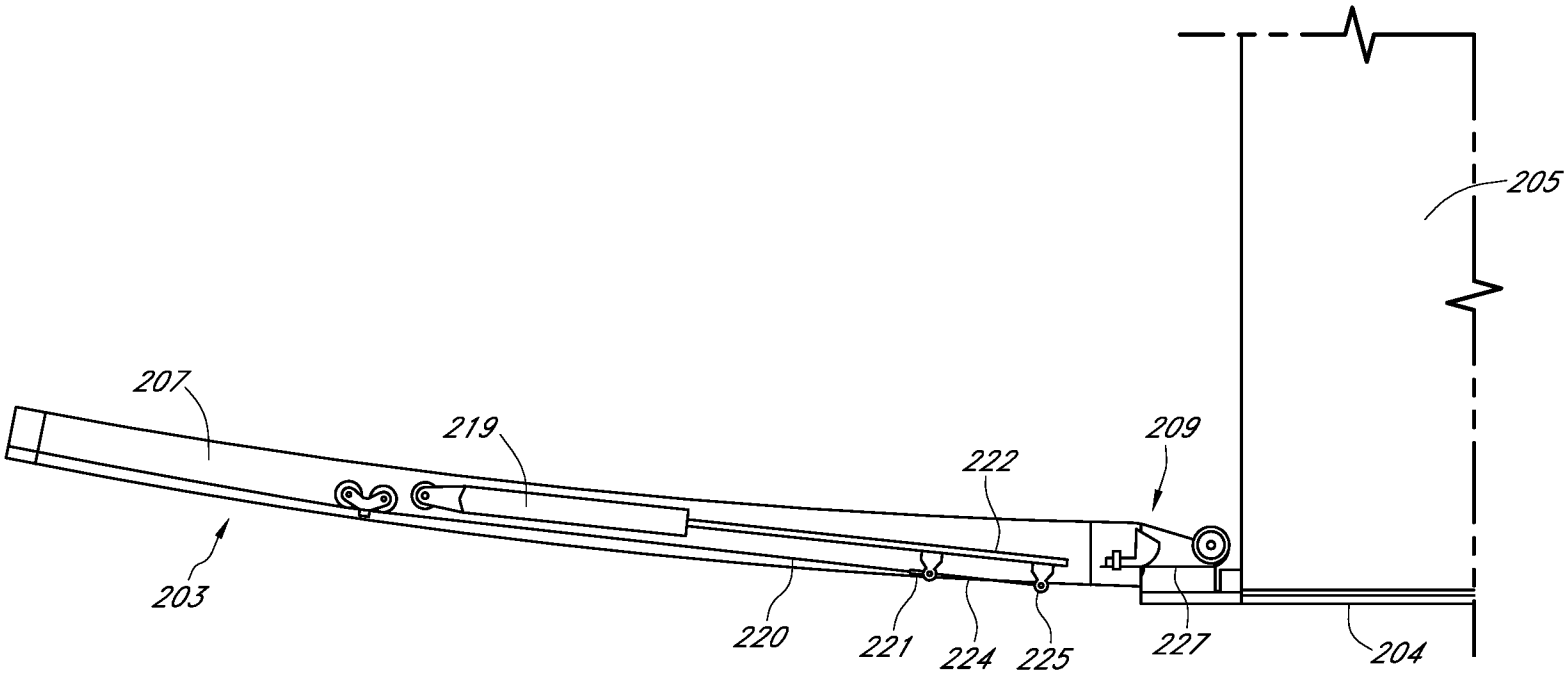
FIGS. 17B-17C are cross-sectional views of the embodiment of the parabolic antenna reflector illustrated in FIG. 17A, showing a rib in a deployed configuration and a stowed configuration, respectively.
Figure 17C:
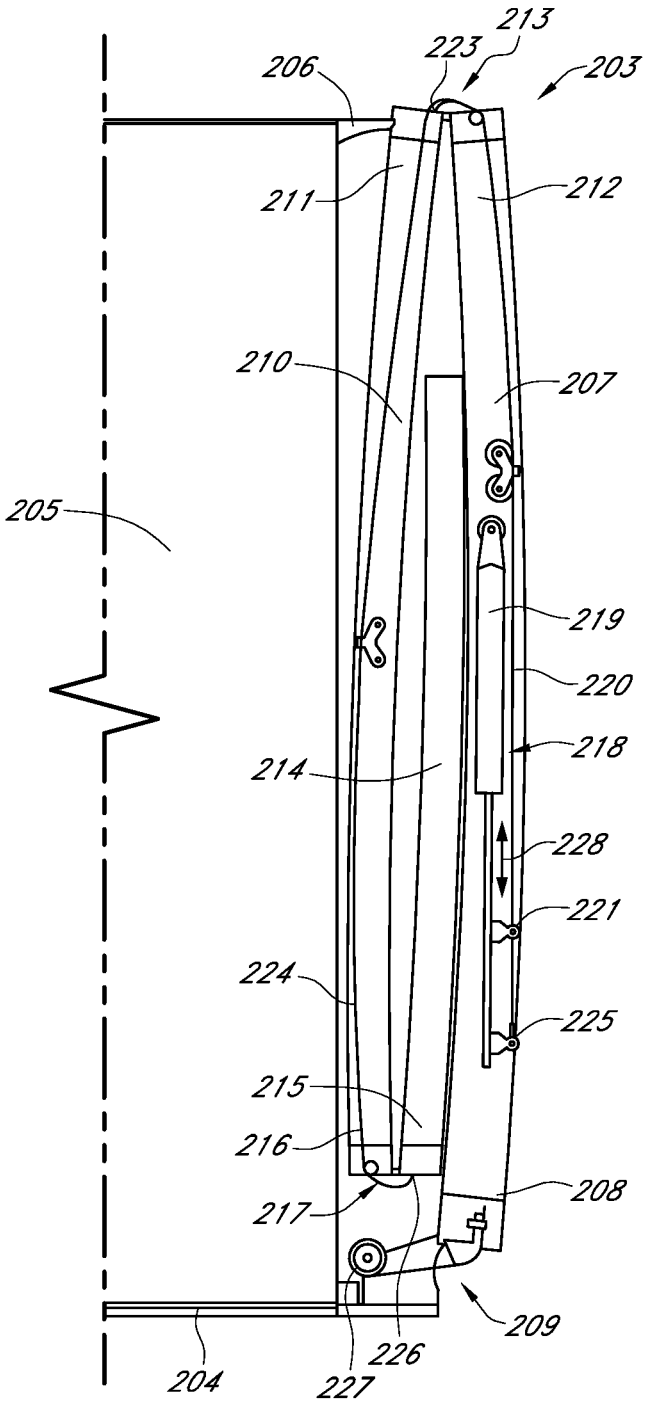

Although in one or more embodiments each of the root, intermediate, and tip rib segments 109, 110, 111 of each rib 103 are independently or separately actuated by separate actuators (e.g., each of the root, intermediate, and tip rib segments 109, 110, 111 may be independently actuated by the linear actuator 146 coupled to the planar quadrilateral linkage 145 illustrated in FIG. 11), in one or more embodiments the root, intermediate, and tip rib segments 109, 110, 111 of each rib 103 may be actuated together (e.g., the root, intermediate, and tip rib segments 109, 110, 111 of each rib 103 may be actuated together by a single actuator). For instance, FIGS. 17A-17C depict a parabolic antenna reflector 200 according to another embodiment of the present disclosure in which the rib segments of each rib are actuated by a single actuator mechanism. In the illustrated embodiment, the parabolic antenna reflector 200 includes a flexible reflective material 201, a flexible net 202, a plurality of ribs 203 configured to support the flexible reflective material 201, and a central hub 204. The parabolic antenna reflector 200 may include any suitable number of ribs 203, such as, for example, 36 ribs 203. In one or more embodiments, the configuration of the flexible reflective material 201, the flexible net 202, the plurality of ribs 203, and the central hub 204 may be the same as or similar to the configuration of the flexible reflective material 101, the flexible net 102, the plurality of ribs 103, and the central hub 104 described above with reference to the embodiment illustrated in FIGS. 1-10 and 12-16G. In one or more embodiments, the parabolic antenna reflector 200 may be provided without the flexible net 202. In the illustrated embodiment, the reflector 200 also includes a central structure 205 coupled to the central hub 204 and launch locks 206 coupled to the central structure 205. In the illustrated embodiment, the launch locks 206 are coupled to the upper end of the central structure 205 and the central hub 204 is coupled to the lower end of the central structure 205. The ribs 203 are configured to move between a stowed configuration for launch and a deployed configuration for operation in which the ribs 203 support the flexible reflective material 201 in a parabolic configuration. The launch locks 206 are configured to secure the ribs 203 in the stowed configuration. Additionally, in one or more embodiments, the parabolic antenna reflector 200 may include a flexible restraining band extending around an outer periphery of the ribs 203 in the stowed configuration, and a hold down and release mechanism (HDRM), such as a thermal knife, coupled to the flexible restraining band and configured to sever the flexible restraining band to permit the ribs 203 of the parabolic antenna reflector 200 to move into the deployed configuration. The flexible restraining band and the HDRM may be the same as or similar to the configuration of the flexible restraining band 107 and the HDRM 108 described above with reference to the embodiment illustrated in FIG. 14.

In the illustrated embodiment, each rib 203 includes a root rib segment 207 having a proximal end 208 hingedly coupled to the central hub 204 with a first hinge 209, at least one intermediate rib segment 210 having a proximal end 211 hingedly coupled to a distal end 212 of the root rib segment 207 with a second hinge 213, and a tip rib segment 214 having a proximal end 215 hingedly coupled to a distal end 216 of the at least one intermediate rib segment 210 with a third hinge 217. In one or more embodiments, each of the hinges 209, 213, 217 may include a hinge clevis and a hinge lug hingedly coupled to the hinge clevis with a pin. In one or more embodiments, the hinges 209, 213, 217 may be the same as or similar to the hinges 113, 116, 119 described above with reference to the embodiment illustrated in FIGS. 8A-8C. Additionally, in one or more embodiments, each of the rib segments 207, 210, 214 may be a beam having a parabolic curve on a concave side of the beam and a taper on a convex side of the beam similar to the beam 138 illustrated in FIGS. 9-10.

Additionally, in the illustrated embodiment, for each rib 203, the root rib segment 207, the at least one intermediate rib segment 210, and the tip rib segment 214 are actuated together into the deployed position by a single actuator mechanism 218 (e.g., the parabolic antenna reflector 200 includes one actuator mechanism 218 coupled to each of the ribs 203). In one or more embodiments, the actuator mechanism 218 includes an actuator 219 (e.g., an electromagnetic actuator, a hydraulic actuator (such as a HOP actuator), a pneumatic actuator, a strain energy device, or combinations thereof) coupled to the root rib segment 207. In one or more embodiments, the actuator mechanism 218 also includes one or more tensile members (e.g., one or more cables) connecting the output of the actuator 219 to the at least one intermediate rib segment 210 and to the tip rib segment 214. In one or more embodiments, the actuator mechanism 218 may include a first cable 220 having a proximal end 221 coupled (e.g., fixedly coupled) to an output end 222 (e.g., a rod) of the actuator 219 and a distal end 223 coupled (e.g., fixedly coupled) to the proximal end 211 of the at least one intermediate rib segment 210 (e.g., coupled to the second hinge 213), and a second cable 224 having a proximal end 225 coupled (e.g., fixedly coupled) to the output end 222 of the actuator 219 and a distal end 226 coupled to the proximal end 215 of the tip rib segment 214 (e.g., coupled to the third hinge 217). Although in one or more embodiments the actuator mechanism 218 includes two cables 220, 224, in one or more embodiments, the actuator mechanism 218 may include any other suitable number of cables, depending, for instance, on the number of rib segments of each rib 203. In one or more embodiments, the number of cables of the actuator mechanism 218 may correspond to the number of intermediate and tip rib segments (e.g., in one or more embodiments in which the ribs 203 include two intermediate rib segments 210 and a single tip rib segment 214, the actuator mechanism 218 may include three cables).

In one or more embodiments, each of the cables 220, 224 of the actuator mechanism 218 may pass over and engage a lever, a cam, or any other suitable feature for providing mechanical advantage that aids the cables 220, 224 in rotating the intermediate and tip rib segments 210, 214 into the deployed configuration.

Additionally, in one or more embodiments, the actuator mechanism 218 may include a spring 227 (e.g., a constant force spring) coupled to the proximal end 208 of the root rib segment 207 (e.g., coupled to the first hinge 209). The spring 227 is configured to bias and move the root rib segment 207 into the deployed position (e.g., upon release of the launch locks 206 and/or severing of the flexible restraining band by the HDRM). In one or more embodiments, the actuator mechanism 218 may include any other suitable mechanism for moving the root rib segment 207 into the deployed configuration.

Once the spring 227 or other mechanism has moved the root rib segment 207 of each rib 203 into the deployed position, the actuator 219 for each rib 203 may be actuated (arrow 228) to sequentially deploy the at least one intermediate rib segment 210 and the tip rib segment 214 of each rib 203 into the deployed configuration, illustrated in FIG. 17B. In one or more embodiments, actuation of the actuator 219 is configured to pull the proximal ends 221, 225 of the cables 220, 224 toward the proximal end 208 of the root rib segment 207, which causes the distal ends of the cables 220, 224 to pull on the proximal ends 211, 215 of the at least one intermediate rib segment 210 and the tip rib segment 214, respectively, and thereby sequentially rotate the at least one intermediate rib segment 210 and the tip rib segment 214 into the deployed configuration. In one or more embodiments, the cables 220, 224 may engage one or more levers, cams, and/or other suitable devices creating mechanical advantage that aid the cables 220, 224 and the actuator 219 in moving the at least one intermediate rib segment 210 and the tip rib segment 214 into the deployed configuration. Accordingly, in the embodiment illustrated in FIGS. 17A-17C, the reflector 200 includes one actuator mechanism 218 per rib 203 for collective, staged deployment of the respective rib segments 207, 210, 214 (e.g., a single actuator mechanism 218 is utilized to collectively and sequentially deploy the root rib segment 207, the at least one intermediate rib segment 210, and the tip rib segment 214 of each rib 203). In one or more embodiments, the reflector 200 may include actuator mechanisms configured to individually deploy the rib segments 207, 210, 214 (e.g., each rib 203 of the reflector 200 may include a number of actuator mechanisms corresponding to the number of rib segments 207, 210, 214).

Figure 18:
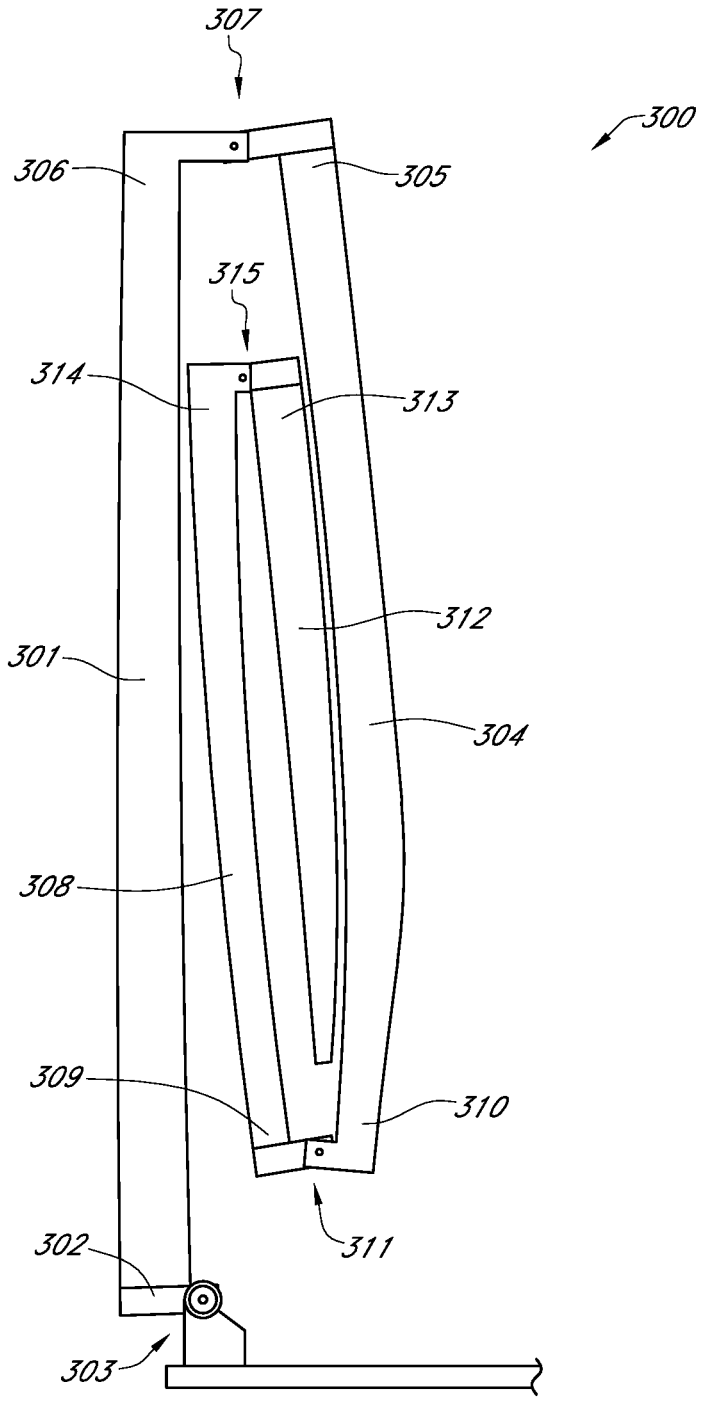
FIG. 18 is a side view of a rib according to one embodiment of the present disclosure.

Although in one or more embodiments each of the ribs 203 includes three rib segments 207, 210, 214, in one or more embodiments, each of the ribs may include any other suitable number of rib segments, such as four or more rib segments. FIG. 18 depicts a rib 300 according to one embodiment of the present disclosure including four rib segments. The embodiment of the rib 300 illustrated in FIG. 18 may be utilized in the embodiment of the parabolic antenna reflector 100 illustrated in FIGS. 2-6, the embodiment of the parabolic antenna reflector 200 illustrated in FIGS. 17A-17C, or any other parabolic antenna reflector. In the illustrated embodiment, the rib 300 includes a root rib segment 301 having a proximal end 302 hingedly coupled to a central hub (e.g., the central hub 104 in FIG. 8B or the central hub 204 in FIGS. 17A-17C) with a first hinge 303, a first intermediate rib segment 304 having a proximal end 305 hingedly coupled to a distal end 306 of the root rib segment 301 with a second hinge 307, a second intermediate rib segment 308 having a proximal end 309 hingedly coupled to a distal end 310 of the first intermediate rib segment 304 with a third hinge 311, and a tip rib segment 312 having a proximal end 313 hingedly coupled to a distal end 314 of the second intermediate rib segment 308 with a fourth hinge 315. In one or more embodiments, each of the hinges 303, 307, 311, 315 may include a hinge clevis and a hinge lug hingedly coupled to the hinge clevis with a pin. In one or more embodiments, the hinges 303, 307, 311, 315 may be the same as or similar to the hinges 113, 116, 119 described above with reference to the embodiment illustrated in FIGS. 8A-8C. Additionally, in one or more embodiments, each of the rib segments 301, 304, 308, 312 may be a beam having a parabolic curve on a concave side of the beam and a taper on a convex side of the beam similar to the beam 138 illustrated in FIGS. 9-10. In the stowed position, the first and second intermediate rib segments 304, 308 are stowed between the parabolic, concave sides of the root rib segment 301 and the tip rib segment 312.

The root rib segment 301, the first intermediate rib segment 304, the second intermediate rib segment 308, and the tip rib segment 312 are configured to sequentially deploy into the deployed configuration. In one or more embodiments, the root rib segment 301, the first intermediate rib segment 304, the second intermediate rib segment 308, and the tip rib segment 312 of each rib 300 may be actuated together by a single actuator mechanism (e.g., the actuator mechanism 218 illustrated in FIGS. 17A-17C). In one or more embodiments, the root rib segment 301, the first intermediate rib segment 304, the second intermediate rib segment 308, and the tip rib segment 312 may be individually actuated by separated actuators (e.g., each of the root rib segment 301, the first intermediate rib segment 304, the second intermediate rib segment 308, and the tip rib segment 312 may be independently actuated by the linear actuator 146 coupled to the planar quadrilateral linkage 145 illustrated in FIG. 11).

A number of embodiments of the disclosure have been described. The embodiments described herein are not to be taken in a limiting sense, but rather are made for the purpose of illustrating the general principles of the embodiments of the reflector 100. It will be understood that various modifications may be made without departing from the spirit and scope of the present disclosure. Accordingly, other embodiments are within the scope of the following claims.

The examples set forth above are provided to those of ordinary skill in the art as a complete disclosure and description of how to make and use the embodiments of the disclosure, and are not intended to limit the scope of what the inventor/inventors regard as their disclosure.

Modifications of the above-described modes for carrying out the methods and systems herein disclosed that are obvious to persons of skill in the art are intended to be within the scope of the following claims.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. A reflector assembly configured to move between a stowed configuration and a deployed configuration, the reflector assembly comprising:

a central hub defining a central axis;

a plurality of ribs coupled to the central hub, each rib of the plurality of ribs comprising:

a root rib segment rotatably coupled to the central hub by a first hinge defining a first axis, the root rib segment configured to rotate in a first direction about the first axis away from the central axis of the central hub as the reflector assembly moves into the deployed configuration;

at least one intermediate rib segment having a proximal end rotatably coupled to a distal end of the root rib segment by a second hinge defining a second axis substantially parallel to the first axis, the at least one intermediate rib segment configured to rotate in the first direction about the second axis as the reflector assembly moves into the deployed configuration and after the root rib segment reaches a fully deployed configuration; and a tip rib segment having a proximal end rotatably coupled to a distal end of the at least one intermediate rib segment by a third hinge defining a third axis substantially parallel to the second axis, the tip rib segment configured to rotate in the first direction about the third axis as the reflector assembly moves into the deployed configuration and after the at least one intermediate rib segment reaches a fully deployed configuration; and a flexible reflective material attached to the plurality of ribs, wherein the flexible reflective material and the plurality of ribs together form a reflective surface with a substantially paraboloidal surface profile configured to focus electromagnetic energy when the reflector assembly is in the deployed position.

2. The reflector assembly of claim 1, wherein the at least one intermediate rib segment comprises a first intermediate rib segment and a second intermediate rib segment rotatably coupled to the first intermediate rib segment.

3. The reflector assembly of claim 1, wherein, when the reflector assembly is in the stowed configuration:

a longitudinal axis of the root rib segment of each of the plurality of ribs is substantially parallel with the central axis of the central hub, a longitudinal axis of the at least one intermediate rib segment of each of the plurality of ribs is substantially parallel with the central axis of the central hub, and is positioned between the central axis of the central hub and the longitudinal axis of the root rib segment, and a longitudinal axis of the tip rib segment of each of the plurality of ribs is substantially parallel with the central axis of the central hub, and is positioned between the longitudinal axis of the root rib segment and the longitudinal axis of the at least one intermediate rib segment.

4. The reflector assembly of claim 3, wherein:

the root rib segment of each of the plurality of ribs comprises a concave profile, the at least one intermediate rib segment of each of the plurality of ribs comprises a concave profile, and the tip rib segment is positioned in a space defined between the concave profile of the root rib segment and the concave profile of the at least one intermediate rib segment when the reflector assembly is in the stowed configuration.

5. The reflector assembly of claim 1, further comprising at least one deployment mechanism coupled to each rib of the plurality of ribs, wherein the at least one deployment mechanism is configured to move the root rib segment, the at least one intermediate rib segment, and the tip rib segment of each rib into a deployed configuration.

6. The reflector assembly of claim 5, wherein the deployment mechanism comprises a device selected from the group of devices consisting of a pneumatic actuator, a hydraulic actuator, an electromagnetic actuator, a strain energy device, and combinations thereof.

7. The reflector of claim 5, wherein the at least one deployment mechanism comprises:

a planar quadrilateral linkage; and an actuator operably coupled to the planar quadrilateral linkage.

8. The deployable reflector of claim 5, wherein the at least one deployment mechanism comprises an elastic object that stores mechanical energy when deformed.

9. The deployable reflector of claim 5, wherein the at least one deployment mechanism comprises a single deployment mechanism configured to collectively and sequentially deploy the root rib segment, the at least one intermediate rib segment, and the tip rib segment of one rib of the plurality or ribs into the deployed configuration.

10. The deployable reflector of claim 5, wherein the at least one deployment mechanism comprises a plurality of deployment mechanisms configured to individually actuate the root rib segment, the at least one intermediate rib segment, and the tip rib segment into the deployed configuration.

11. The reflector assembly of claim 1, wherein the substantially paraboloidal surface profile is configured to focus electromagnetic energy within a frequency range from approximately 500 MHz to approximately 40 GHz.

12. The reflector assembly of claim 1, further comprising a flexible net coupled to the flexible reflective material and the plurality of ribs.

13. The reflector assembly of claim 12, wherein the flexible net comprises substantially inextensible material.

14. The deployable reflector of claim 1, wherein the flexible reflective material comprises a woven wire mesh.

15. The deployable reflector of claim 1, further comprising a substantially cylindrical central structure coupled to the central hub.

16. The deployable reflector of claim 1, wherein the deployable reflector, in the stowed configuration, is configured to be contained within a volume of approximately 24 inches×approximately 24 inches×approximately 38 inches.

17. The deployable reflector of claim 1, wherein the deployable reflector in the deployed configuration has a deployed diameter of approximately 4.0 meters.

18. The method of claim 17, wherein, in the stowed configuration:

a longitudinal axis of the root rib segment of each of the plurality of ribs is substantially parallel with the central axis of the central hub, a longitudinal axis of the intermediate rib segment of each of the plurality of ribs is substantially parallel with the central axis of the central hub, and is positioned between the central axis of the central hub and the longitudinal axis of the root rib segment, and a longitudinal axis of the tip rib segment of each of the plurality of ribs is substantially parallel with the central axis of the central hub, and is positioned between the longitudinal axis of the root rib segment and the longitudinal axis of the intermediate rib segment.

19. The deployable reflector of claim 1, further comprising:

a band extending around the deployable reflector in the stowed configuration; and a hold down and release mechanism coupled to the band, wherein activation of the hold down and release mechanism is configured release tension in the band and allow the deployable reflector to move into the deployed configuration.

20. A reflector assembly configured to move between a stowed configuration and a deployed configuration, the reflector assembly comprising:

a central hub defining a central axis;

a plurality of ribs coupled to the central hub, each rib of the plurality of ribs comprising:

a root rib segment rotatably coupled to the central hub by a first hinge, the root rib segment configured to rotate in a first direction about a first axis away from the central axis of the central hub as the reflector assembly moves into the deployed configuration;

at least one intermediate rib segment having a proximal end rotatably coupled to a distal end of the root rib segment by a second hinge, the at least one intermediate rib segment configured to rotate in the first direction about a second axis substantially parallel to the first axis as the reflector assembly moves into the deployed configuration; and a tip rib segment having a proximal end rotatably coupled to a distal end of the at least one intermediate rib segment by a third hinge, the tip rib segment configured to rotate in the first direction about a third axis substantially parallel to the second axis as the reflector assembly moves into the deployed configuration; and a flexible reflective material attached to the plurality of ribs, wherein the flexible reflective material and the plurality of ribs together form a reflective surface with a substantially paraboloidal surface profile configured to focus electromagnetic energy when the reflector assembly is in the deployed position at least one deployment mechanism coupled to each rib of the plurality of ribs, wherein the at least one deployment mechanism is configured to move the root rib segment, the at least one intermediate rib segment, and the tip rib segment of each rib into a deployed configuration, wherein the at least one deployment mechanism comprises:

a planar quadrilateral linkage; and an actuator operably coupled to the planar quadrilateral linkage, wherein the planar quadrilateral linkage comprises:

a ground link;

an input link coupled to the linear actuator and rotatably coupled to the ground link;

an output link coupled to one of the root rib segment, the intermediate rib segment, and the tip rib segment, the output link being rotatably coupled to the ground link; and a floating link rotatably coupled to the output link and the input link, wherein activation of the actuator is configured to rotate the input link and rotation of the input link is configured to rotate the output link.

21. A deployable reflector assembly configured to move between a stowed configuration and a deployed configuration, the deployable reflector assembly comprising:

a central hub defining a central axis;

a plurality of root rib segments, each root rib segment of the plurality of root rib segments attached to the central hub with a rotating hinge and configured to rotate in a first direction away from the central axis of the central hub upon deployment into the deployed configuration;

a plurality of intermediate rib segments equal in number to the plurality of root rib segments, each intermediate rib segment of the plurality of intermediate rib segments attached at a proximal end of the intermediate rib segment to a distal end of a corresponding root rib segment with a rotating hinge and configured to rotate in substantially the same direction as, and about an axis substantially parallel to, the corresponding root rib segment upon deployment into the deployed configuration and after the corresponding root rib segment reaches a fully deployed configuration;

a plurality of tip rib segments equal in number to the plurality of intermediate rib segments, each tip rib segment of the plurality of tip rib segments attached at a proximal end of the tip rib segment to a distal end of a corresponding intermediate rib segment with a rotating hinge and configured to rotate in substantially the same direction as, and about an axis substantially parallel to, the corresponding intermediate rib segment upon deployment into the deployed configuration and after the corresponding intermediate rib segment reaches a fully deployed configuration; and a flexible reflective material attached to the plurality of root rib segments, the plurality of intermediate rib segments, and the plurality of tip rib segments, wherein a longitudinal axis of each root rib segment of the plurality of root rib segments is substantially aligned with the central axis of the central hub when in the stowed configuration, wherein a longitudinal axis of each intermediate rib segment of the plurality of intermediate rib segments is substantially aligned with the central axis of the central hub when in the stowed configuration, wherein the longitudinal axis of each intermediate rib segments is between the central axis of the hub and the longitudinal axis of the corresponding root rib segment when in the stowed configuration, wherein a longitudinal axis of each tip rib segment of the plurality of tip ribs is substantially aligned with the central axis of the central hub when in the stowed configuration, and wherein each tip rib segment of the plurality of tip ribs is positioned in a space between a concave profile of the corresponding root rib segment and a concave profile of the corresponding intermediate rib segment when in the stowed configuration.

22. A method of operating a deployable reflector assembly comprising a central hub, a plurality of ribs coupled to the central hub, each rib of the plurality of ribs comprising a root rib segment rotatably coupled to the central hub, an intermediate rib segment rotatably coupled to the root rib segment, and a tip rib segment rotatably coupled to the intermediate rib segment, and a flexible reflective material attached to the plurality of ribs, the method comprising:

moving the deployable reflector assembly from a stowed configuration to a deployed configuration, wherein the moving the deployable reflector assembly from the stowed configuration to the deployed configuration comprises:

rotating, in a first direction away from the central axis of the central hub, the root rib segment of each rib of the plurality of ribs relative to the central hub into a fully deployed configuration;

rotating, in the first direction, an intermediate rib segment of each rib of the plurality of ribs relative to the root rib segment into a fully deployed configuration after the rotating of the root rib segment into the fully deployed configuration; and rotating, in the first direction, a tip rib segment of each rib of the plurality of ribs relative to the intermediate rib segment into a fully deployed configuration after the rotating of the intermediate rib segment into the fully deployed configuration.

23. The method of claim 22, further comprising moving the deployable reflector from the deployed configuration to the stowed configuration, wherein the moving the deployable reflector from the deployed configuration to the stowed configuration comprises:

rotating, in a second direction opposite the first direction, the tip rib segment of each rib of the plurality of ribs relative to the intermediate rib segment;

rotating, in the second direction, the intermediate rib segment of each rib of the plurality of ribs relative to the root rib segment; and rotating, in the second direction, the root rib segment of each rib of the plurality of ribs relative to the central hub.

* * * * *